US006701708B2

(12) United States Patent
Gross et al.

(10) Patent No.: US 6,701,708 B2
(45) Date of Patent: Mar. 9, 2004

(54) MOVEABLE REGENERATOR FOR STIRLING ENGINES

(75) Inventors: William T. Gross, Pasadena, CA (US); Denes L. Zsolnay, Rolling Hills Estate, CA (US); Kurt E. Jechel, San Juan Capistrano, CA (US)

(73) Assignee: Pasadena Power, Pasadena, CA (US)

( * ) Notice: Subject to any disclaimer, the term of this patent is extended or adjusted under 35 U.S.C. 154(b) by 0 days.

(21) Appl. No.: 10/138,931

(22) Filed: May 3, 2002

(65) Prior Publication Data

US 2003/0000210 A1 Jan. 2, 2003

Related U.S. Application Data

(60) Provisional application No. 60/291,718, filed on May 17, 2001, and provisional application No. 60/288,405, filed on May 3, 2001.

(51) Int. Cl.[7] ..... F01B 29/00; F25B 9/00; F02G 1/04

(52) U.S. Cl. ..... 60/517; 60/519; 60/520; 60/526; 62/6

(58) Field of Search ..... 60/517, 520, 526, 60/519, 525; 62/6

(56) References Cited

U.S. PATENT DOCUMENTS

| | | | | |
|---|---|---|---|---|
| 5,502,968 | A | 4/1996 | Beale | 60/520 |
| 5,533,335 | A | 7/1996 | Shin | 60/517 |
| 5,555,729 | A | 9/1996 | Momose et al. | 60/517 |
| 5,590,526 | A | 1/1997 | Cho | 60/517 |
| 5,611,201 | A | 3/1997 | Houtman | 60/517 |
| 5,638,684 | A | 6/1997 | Siegel et al. | 62/6 |
| 5,644,917 | A | 7/1997 | McWaters | 60/517 |
| 5,706,659 | A | 1/1998 | Houtman et al. | 60/517 |
| 5,711,232 | A | 1/1998 | Yamaguro et al. | 60/517 |
| 5,722,239 | A | 3/1998 | Houtman | 60/517 |
| 5,755,100 | A | 5/1998 | Lamos | 60/521 |
| 5,771,694 | A | 6/1998 | Houtman et al. | 60/517 |
| 5,782,084 | A | 7/1998 | Jarvis | 60/517 |
| 5,813,229 | A | 9/1998 | Gaiser | 60/517 |
| 5,836,846 | A | 11/1998 | Hewko et al. | 475/149 |
| 5,865,091 | A | 2/1999 | Domanski et al. | 60/517 |
| 5,878,570 | A | 3/1999 | Reithofer | 60/520 |
| 5,907,201 | A | 5/1999 | Hiterer et al. | 60/520 |
| 5,918,463 | A | 7/1999 | Penswick et al. | 60/517 |
| 5,987,886 | A | 11/1999 | Sekiya et al. | 60/526 |
| 6,041,598 | A | 3/2000 | Bliesner | 60/517 |
| 6,062,023 | A | 5/2000 | Kerwin et al. | 60/520 |
| 6,112,606 | A | 9/2000 | Shin | 60/517 |
| 6,161,381 | A | 12/2000 | Lohrmann | 60/523 |
| 6,161,389 | A | 12/2000 | Sekiya et al. | 62/6 |
| 6,195,992 | B1 | 3/2001 | Nommensen | 60/519 |
| 6,205,782 | B1 | 3/2001 | Kinnersly | 60/517 |
| 6,220,030 | B1 | 4/2001 | Clucas et al. | 60/517 |
| 6,253,550 | B1 | 7/2001 | Langenfeld et al. | 60/525 |
| 6,263,671 | B1 | 7/2001 | Bliesner | 60/517 |
| 6,279,325 | B1 | 8/2001 | Sekiya et al. | 62/6 |
| 6,338,248 | B1 | 1/2002 | Waidner et al. | 60/521 |
| 6,381,958 | B1 | 5/2002 | Kamen et al. | 60/524 |
| 6,389,811 | B2 | 5/2002 | Urasawa et al. | 60/517 |
| 6,470,679 | B1 * | 10/2002 | Ertle | 60/526 |
| 2001/0049938 | A1 | 12/2001 | Urasawa et al. | 60/517 |
| 2002/0005043 | A1 | 1/2002 | Rudick et al. | 62/6 |
| 2002/0029567 | A1 | 3/2002 | Kamen et al. | 60/517 |
| 2002/0096884 | A1 | 7/2002 | Budliger | 290/1 R |

* cited by examiner

*Primary Examiner*—Sheldon J. Richter
(74) *Attorney, Agent, or Firm*—Knobbe, Martens, Olson & Bear, LLP.

(57) ABSTRACT

A Stirling cycle engine comprises a substantially sealed engine block that defines a working fluid space, a hot path and a cold path. A heat source and a heat sink are configured to keep the hot path and the cold path at different temperatures. The engine includes a valve chamber that is communication with the working fluid space, the hot path and the cold path. A valve is moveably positioned within the valve chamber between at least a first position and a second position. The valve defines a passage that, in the first position, places the working fluid space in communication with the hot path and, in the second position, places the working fluid space in communication with the cold path. A regenerator positioned within the passage.

22 Claims, 27 Drawing Sheets

MOVEABLE REGENERATOR FOR STIRLING ENGINES

PRIORITY INFORMATION

This application claims the priority benefit under 35 U.S.C. §119(e) of Provisional Application No. 60/288,405 filed May 3, 2001 and Provisional Application No. 60/291,718 filed May 17, 2001, the entire contents of which are expressly incorporated by reference herein.

BACKGROUND OF THE INVENTION

1. Field of the Invention

The present invention relates to engines and, in particular, to Stirling cycle engines.

2. Description of the Related Art

Stirling cycle engines have a theoretical thermodynamic efficiency that is much higher than internal combustion engines. However, Stirling cycle engines are not as widely used as internal combustion engines because Stirling cycle engines typically require complicated hardware, which results in very low power-to-weight and power-to-volume ratios.

For example, a typical Stirling cycle engine includes an enclosed chamber, a displacer piston, a power piston and a crankshaft. The displacer piston is positioned within the enclosed chamber and is connected to the crankshaft by a shaft, which extends through the walls of the chamber. The power piston is also connected to the crankshaft and has one end that is in communication with the interior of the chamber. With respect to the crankshaft, the displacer piston and the power piston are typically 90 degrees out of phase with each other.

In operation, the displacer piston moves working fluid from a cold side of the chamber to a hot side of the chamber. This causes the working fluid to expand. This expansion pushes the power piston, thereby rotating the crankshaft. As the crankshaft rotates, the displacer piston moves the working fluid to the cold side of the chamber. This causes the working fluid to contract, pulling the piston down. As the piston moves back down, the crankshaft rotates and the displacer piston moves the working fluid to the hot side of the chamber, thereby completing the cycle.

There is, therefore, a need for an improved design for a Stirling cycle engine that minimizes at least some of the disadvantages described above.

SUMMARY OF THE INVENTION

The present invention provides for several novel Stirling cycle engine designs, which provide for increased efficiency and better power to volume ratios than conventional designs. In one preferred embodiment, the engine comprises a sealed engine block that defines a cylindrical chamber. A rotary displacer is suitably journalled for rotation within the engine block. A displacer drive motor rotates the rotary displacer and is controlled by a microprocessor. Working fluid in the chamber is in communication with a rolling sock seal piston, which, in turn, is coupled to a generator. For alternately heating and cooling the working fluid, a heat source is located on one side of the sealed chamber and a heat sink is located on another side of the sealed chamber. In modified embodiments, the rotary displacer is counter balanced and/or shaped to reduce aerodynamic drag.

In another embodiment, a Stirling engine comprises a sealed engine block that defines a cylindrical chamber, which encloses a working fluid. The engine block including a first quadrant, a second quadrant, a third quadrant and a fourth quadrant. A rotary displacer is suitably journalled for rotation within the engine block. A displacer drive motor rotates the rotary displacer and is controlled by a microprocessor. Working fluid in the chamber is in communication with a piston. A heat source is configured to heat the first and third quadrants, which oppose each other. A heat sink is configured to cool the second and fourth quadrants, which oppose each other. The rotary displacer moves between a first position wherein most of the working fluid is the second and forth quadrants and a second position wherein most of the working fluid is in the first and third quadrants.

In yet another embodiment, a Stirling engine comprises a sealed engine block that defines a generally triangular chamber, which encloses a working fluid. The engine block comprises a hot side, a cold side and a base. A displacer is suitably journalled for pivotal movement within the engine block. A displacer drive motor moves the displacer in an oscillating arc shaped motion and is controlled by a microprocessor. A heat source is configured to heat the hot side of the engine block and a heat sink is configured to cool the cold side of the engine block. The displacer is moveable between a first position wherein most of the working fluid is near the hot side of the engine block and a second position wherein most of the working fluid is near the cold side of the engine block.

In still yet another embodiment, a Stirling engine comprises a sealed engine block, which encloses a working fluid. The engine block comprises a cylindrical inner member and a coaxial cylindrical outer member. A heat source and a heat sink are configured to keep the inner member and the outer member at different temperatures. A displacer is positioned within the chamber and is configured to move between a first position wherein most of the working fluid is near the outer member and a second position wherein most of the working fluid is near the inner member.

In another embodiment, a Stirling engine comprises a sealed engine block, which encloses a working fluid. The engine block defines a working fluid space, a hot path and a cold path. The hot path is connected to the working fluid space at a hot inlet and a hot outlet. The hot path includes a hot inlet valve and a hot outlet valve. The cold path is connected to the working fluid space at a cold inlet and a cold outlet. The cold path includes cold inlet valve and a cold outlet valve. The engine further including a working fluid circulator for circulating the working fluid within the engine. A heat source and a heat sink are configured to keep the hot path and the cold path at different temperatures. A control system is configured to alternately open and close the hot path and the cold path such that the working fluid is alternately circulated through a first past that is defined, at least in part, by the hot path and the working fluid space and a second path that is defined, at least in part, by the cold path and the working fluid space.

In another embodiment, a Stirling cycle engine comprises a substantially sealed engine block that defines a working fluid space, a hot path and a cold path. A heat source and a heat sink are configured to keep the hot path and the cold path at different temperatures. The engine includes a valve chamber that is communication with the working fluid space, the hot path and the cold path. A valve is moveably positioned within the valve chamber between at least a first position and a second position. The valve defines a passage that, in the first position, places the working fluid space in communication with the hot path and, in the second position, places the working fluid space in communication with the cold path. A regenerator positioned within the passage.

In another embodiment, a method of operating a Stirling cycle engine having a substantially sealed engine block that defines a working fluid space, a hot path and a cold path, the method comprises passing a working fluid through the hot path, passing the working fluid into the working space, passing the fluid through a regenerator and into the cold path, passing the fluid through the cold path, moving the regenerator such that it is in communication with the hot path and the working space, passing the fluid into the working space; and passing the fluid through the regenerator into the hot path.

In another embodiment, a Stirling cycle engine comprises a substantially sealed engine block that defines a working fluid space, a hot path and a cold path. A heat source and a heat sink are configured to keep the hot path and the cold path at different temperatures. A valve chamber is in communication with the working fluid space, the hot path and the cold path. The engine further comprises a regenerator and means for moving the regenerator so as to alternately direct working fluid from the working fluid space to the hot path and the cold path.

DETAILED DESCRIPTION OF THE PREFERRED EMBODIMENT

Figure 1:
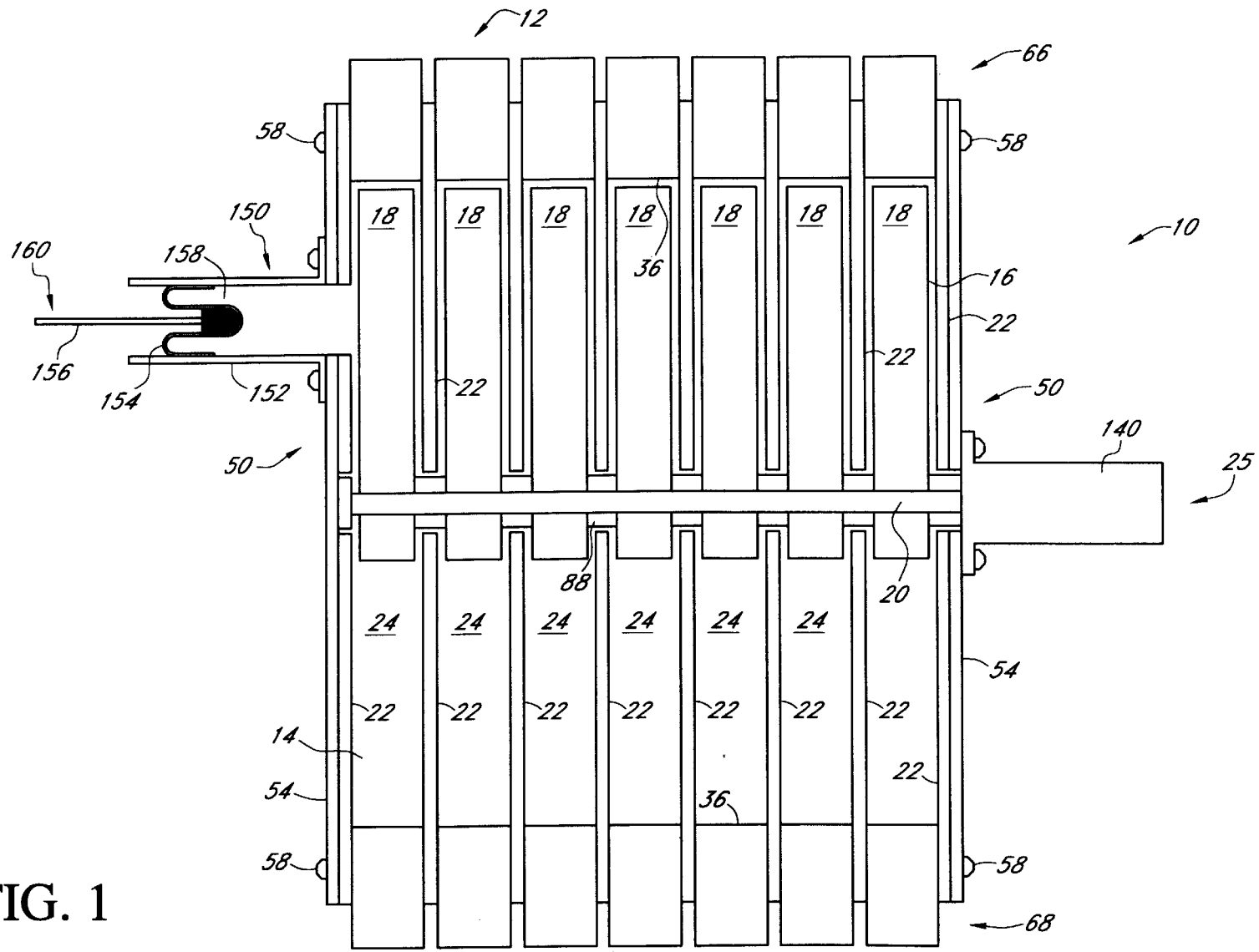
FIG. 1 is a cross-sectional view of a first embodiment of a Stirling engine.
Figure 2:
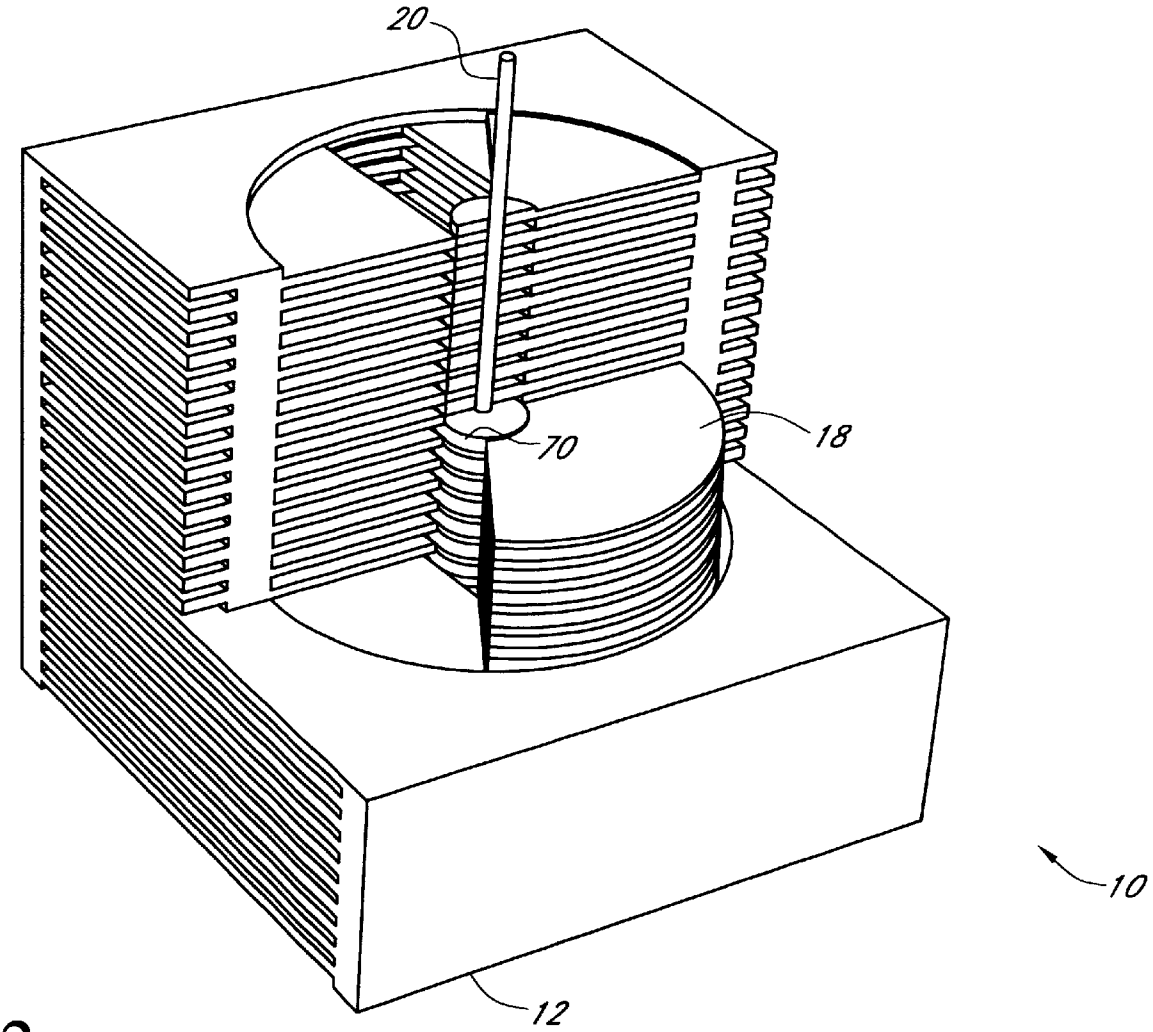
FIG. 2 is a side perspective view with a portion cut away of the engine of FIG. 1.

The present invention is directed to several novel arrangements of a Stirling cycle engine. In a first embodiment, which will be explained in greater detail below, the engine includes a sealed engine block that defines a chamber that may be generally cylindrical in shape. A rotary displacer is suitably journalled for rotation within the engine block. Preferably, the displacer includes a plurality of blades and the engine block includes a plurality of internal fins that are located between each blade of the displacer. A displacer drive motor rotates the rotary displacer and is controlled by a microprocessor. A sealed piston, such as, a rolling sock seal piston is in communication with working fluid in the chamber. Preferably, the piston is coupled to a generator so as to convert the movement of the piston to electrical energy. For alternately heating and cooling the working fluid, a heat source is located on one side of the sealed chamber and a heat sink is located on another side of the sealed chamber. Optionally, the rotary displacer is counter balanced and/or shaped to increase heat transfer between the internal fins and the working fluid.

FIGS. 1–4 illustrate a first embodiment of a rotary Stirling engine 10. With initial reference to FIG. 1, the engine 10 includes an engine block 12, which defines a substantially sealed, generally cylindrical chamber 14. A rotary displacer 16 is positioned within the chamber and comprises a plurality of blades 18, which are coupled to a shaft 20. The shaft 20, in turn, is suitably journalled for rotation within the engine block 12. Specifically, in the illustrated example arrangement, a first end 21 a of the shaft is journalled with bearings 23, which are supported in the engine block 12. A second end 21*b* of the shaft 20 is supported by a drive motor 25, which will be described in more detail below. Of course, alternative methods of journalling the shaft 20 for rotation may be used.

A plurality of internal fins 22 extend between adjacent blades 18. The internal fins 22 divide the chamber 14 into a plurality of sub-chambers 24. Preferably, one blade 18 is positioned within each sub-chamber 24. As shown in FIG. 1, the illustrated engine 10 includes seven sub-chambers 24 and seven blades 18. However, it should be appreciated that the illustrated number of sub-chambers 24 and blades 18 is merely exemplary and modified arrangements may include more or less sub-chambers 24 and/or blades 18.

Figure 3B:
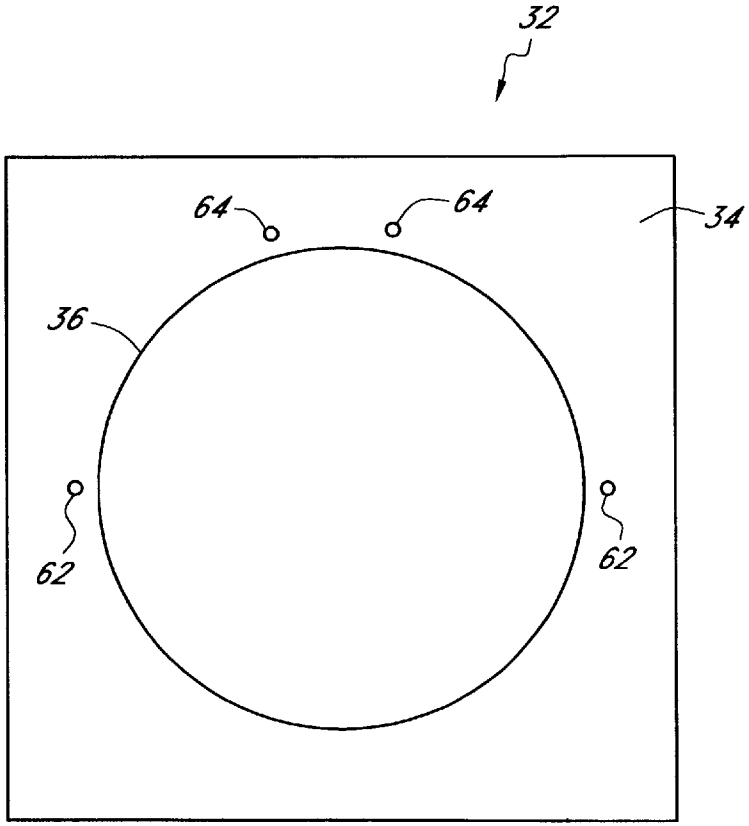
FIGS. 3A–C are top plan views of fin plates and chamber plates that are used to form an engine block of the engine of FIG. 1.
Figure 3A:
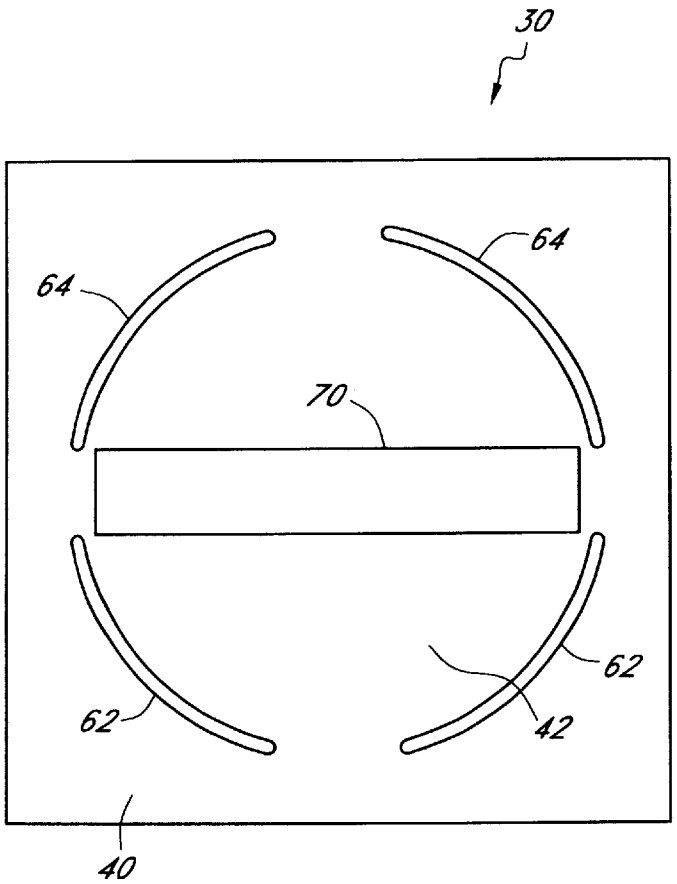

With particular reference to FIGS. 3A and 3B, the engine block 12, the fins 22 and sub-chambers 24 preferably are formed by alternately stacking and rotating a plurality of fin plates 30 and chamber plates 32. With particular reference to FIG. 3B, the chamber plates 32 include a housing portion 34 and an inner surface 36, which defines a generally cylindrical cavity 37. As shown in FIG. 1, the inner surfaces 36 of a series of chamber plates 32 define an outer boundary of the chamber 14 and sub-chambers 22. The chamber plate 32 preferably is made from a material that seals smoothly against the other plates that make up the engine 10, has a coefficient of expansion compatible with plates that contact the chamber plate 32, has high strength at elevated temperatures and has good thermal conductivity, such as, for example, stainless steel.

As shown in FIG. 3A, the fin plates 30 include a housing portion 40 and a fin portion 42. When stacked between the chamber plates 32, the fin portions 42 form the fins 22 that extend between the blades 18. In a similar manner, the housing portions 34, 40 of the chamber plate 32 and the fin plates 30 define the walls of the engine block 12. Preferably, the fin plates 30 are made from a material that has a high thermal conductivity and retains adequate strength at elevated temperatures, such as, for example, copper or aluminum.

With reference back to FIG. 1, two end assemblies 50 are provided for closing the ends the chamber 14. In the illustrated embodiment, the end assemblies 50 include a fin plate 30 and a end plate 54. Of course, the end assemblies 50 may be formed without the fin plate 30.

The fin plates 30, chamber plates 32 and end assemblies 50 preferably are coupled together by a plurality of bolts 58. Preferably, to seal the engine block 12, gaskets (not shown) are provided between the fin plates 30, chamber plates 32 and end assemblies 50. In a modified embodiment, small grooves may be provided in the fin plates 30, chamber plates 32 and/or end assemblies 50. A compressible material, such as, a copper wire, for example, is then positioned within the small grooves. When the engine block 12 is assembled, sufficient pressure is applied to compress the wire and form a tight seal between the parts of the engine block 12.

Figure 3C:
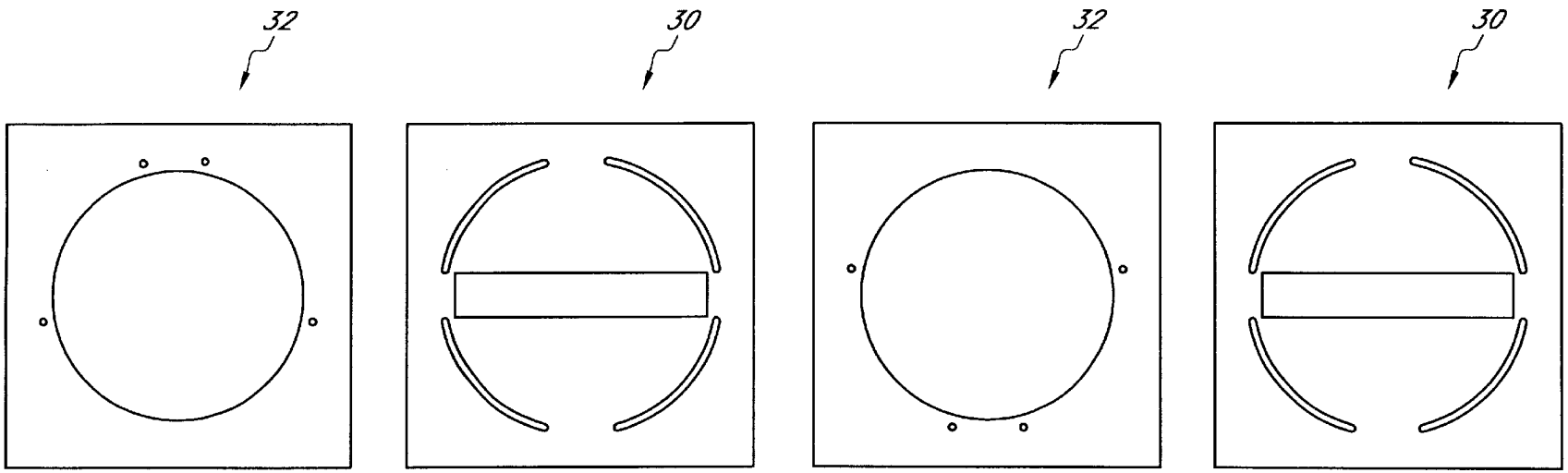
Figure 4:
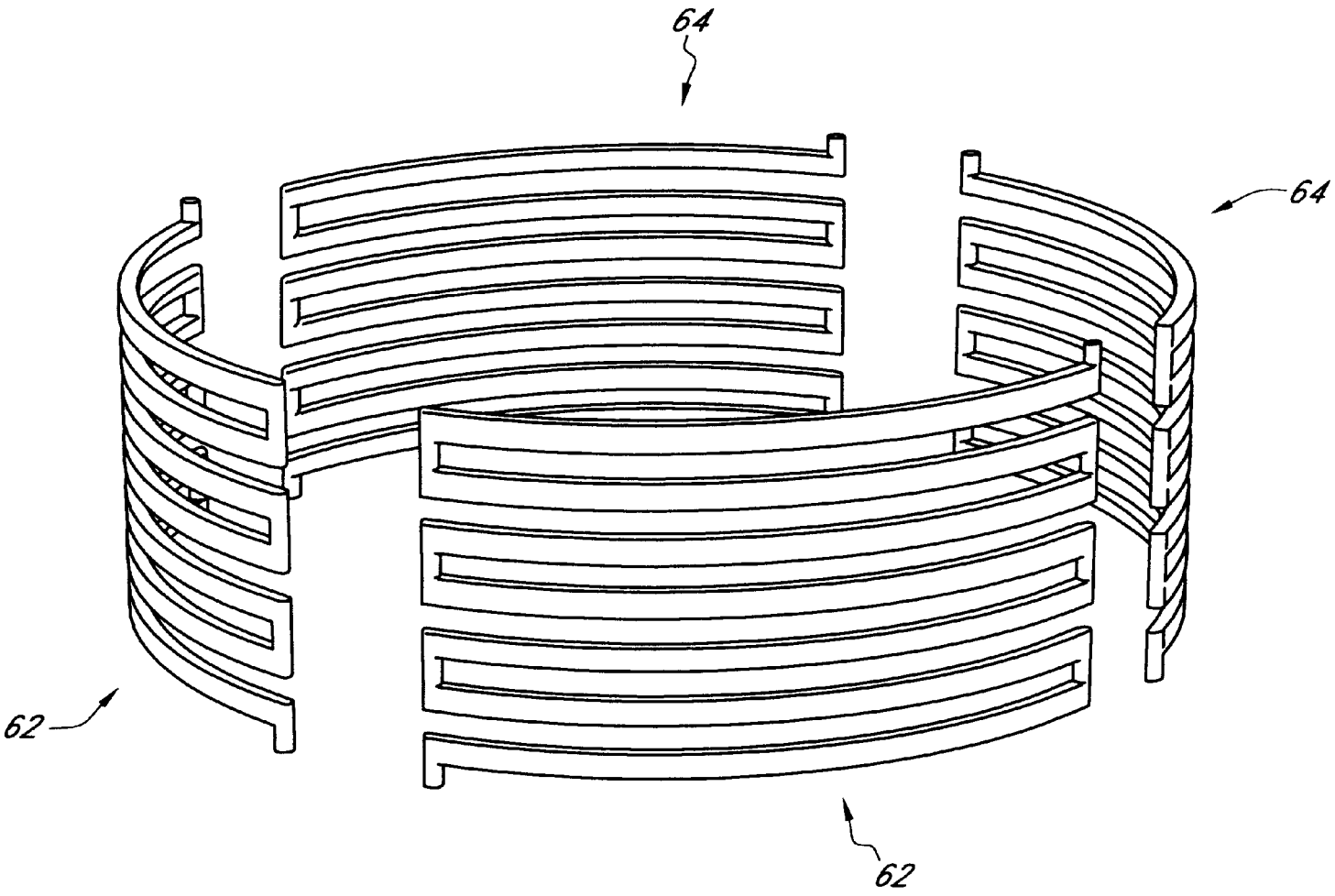
FIG. 4 is a perspective view of hot passages and cold passages in the engine of FIG. 1.

In the illustrated embodiment, the heat source and heat sink comprise a plurality of hot passages 62 and cold passages 64, which are formed in the walls of the engine block 12. With particular reference to FIGS. 3A–C and FIG. 4, the hot and cold fluid passages are defined by the hot channels 63 and cold channels 64 formed in the housing portions 40, 34 of the fin and chamber plates 30, 32. By alternately stacking and rotating 180 degrees the fin plates 30 and chamber plates 32 as shown in FIG. 3C, the hot and cold fluid passages 62, 64 shown in FIG. 4 may be formed. As such, the engine block has a cold side 66 and a hot side 68 (see FIG. 1).

Preferably, the heating fluid (i.e., the fluid in the hot passages) remains liquid at the resting and operating temperatures of the engine (i.e., the boiling point is above the operating temperature of the engine and the melting point is below the resting temperature of the engine), has high thermal conductivity, a low viscosity and is non-corrosive and chemically stable, such as, for example, water (for operating temperatures below 100 degrees Celsius) and silicone oils, perfluorinate polyethers, and liquid sodium (for extremely high operating temperatures). A wide variety of methods may be used to heat the heating fluid. For example, the heating fluid/gas may be heated in a furnace that burns fossil and/or waste fuels. In other embodiments, the heating fluid may be heated by sunlight or geothermal heat.

The cooling fluid (i.e., the fluid in the cooling passages) preferably has good thermal conductivity, a low viscosity and remains a liquid at the resting and operating temperatures of the engine (i.e., the boiling point is above the operating temperature of the engine and the melting point is below the resting temperature of the engine), such as, for example, water at low to intermediate temperatures (i.e., below 100 degrees Celsius), silicone oils, perfluorinate polyethers and commercially available refrigerant liquids that are appropriate for the operating temperatures of the engine. In modified arrangements, it is anticipated that the cooling fluid/gas may be a low-melting-temperature metal alloy, such as, for example, Wood's metal, Bismuth, Lead-Tin solder, Bismuth-Tin allays and Mercury and/or Cadmium. Such metal allows are useful because they have high thermal conductivity and high boiling points, which allows the engine to be operated extremely high temperatures. Large temperature differentials between the hot and cold side of the engine increase the thermodynamic efficiency of the engine.

As with the heating fluid, a wide variety of methods may be used to cool the cooling fluid. For example, the cooling fluid may be cooled by passing the cooling fluid through a cooler, which uses ambient air or water.

Figure 5:
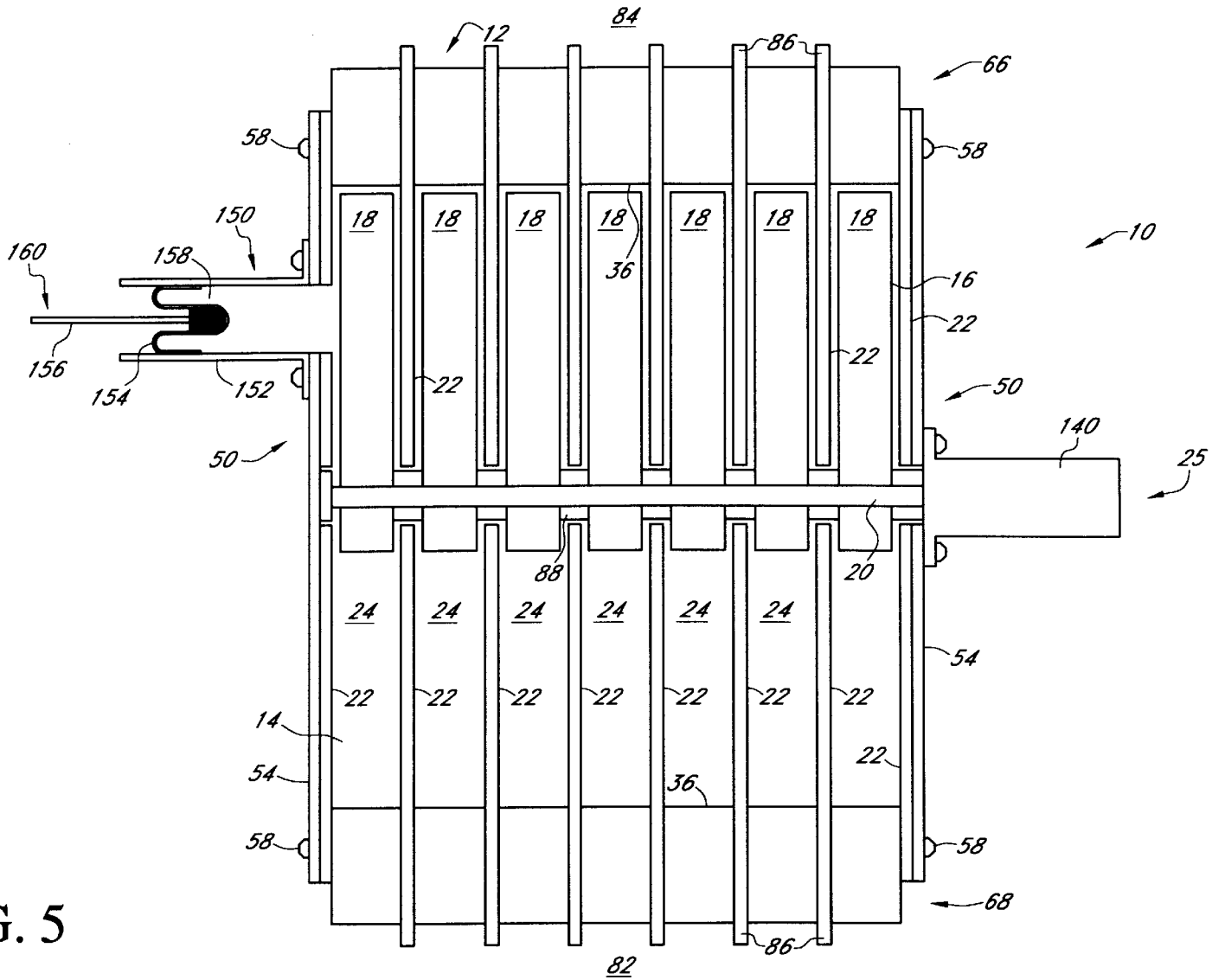
FIG. 5 is a cross-sectional view of a modified embodiment of the engine of FIG. 1.

FIG. 5 illustrates a modified embodiment of a Stirling engine 80 having certain features and advantages according to the present invention. In this embodiment, the engine 80 does not include hot passages and/or cold fluid passages. Instead, the hot side 68 of the engine block is exposed directly a heating source 82, such as, for example, a flame or reflected sunlight. In a similar manner, the cold side 66 may be exposed to a heat sink 84, such as, for example, ambient air or a cooling fluid. Preferably, external fins 86 are provided for increasing the heat transfer between the heat source 82 and/or heat sink 84. More preferably, the external fins 86 form part of the fin plate 22.

With reference back to FIG. 3A, it is readily apparent that one side of the fin plate 30 will be hot while the other side is cold. To prevent excessive heat transfer between the hot and cold sides, the fin plate 30 preferably includes an insulating slot 70. In the illustrated arrangement, the slot 70 has a length that is approximately equal to the diameter of the chamber 14. In a modified embodiment, the insulating slot 70 can be filled with an insulating material that is durable at high temperatures and has low thermal-conductivity, such as, for example, glass, solid ceramics or closed-cell materials that seal well, high temperature polymers, such as various phenolics or teflons. The slot 70 tends to reduce conductive heat transfer by reducing the effective cross-sectional area available for conductive heat transfer. In a modified embodiment, the fin plate 30 may be formed in two separate pieces with an insulating material, such as, for example, the insulating materials described above, separating the two pieces. In a similar manner, the chamber plate 32 may be formed in two separate pieces with an insulating material separating the two pieces.

Figure 6:
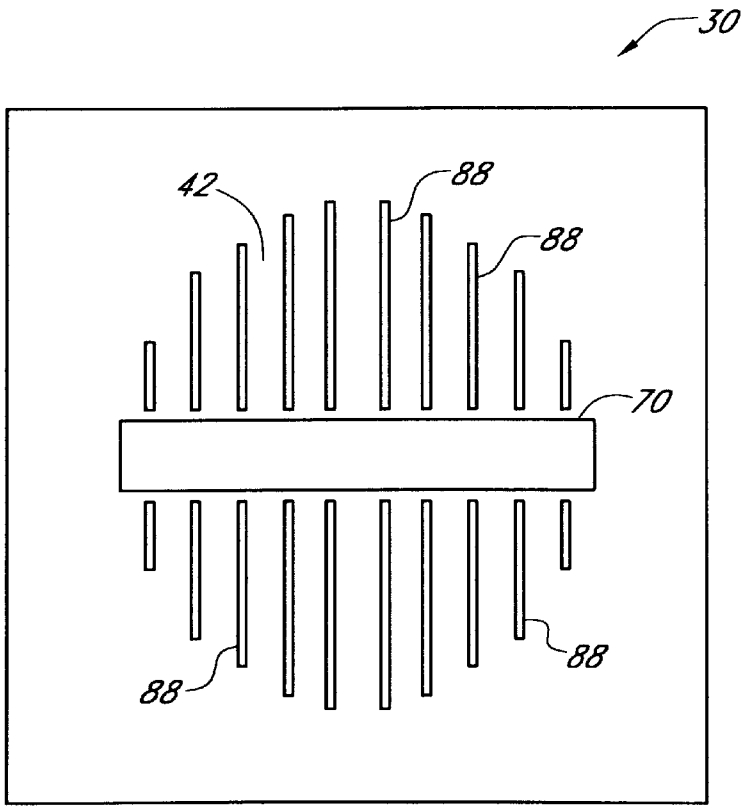
FIG. 6 is a top plan view of a modified embodiment of the fin plates of FIG. 3A.

With reference to FIG. 6, the internal fins 22 may be modified in several ways so as to increase the heat transfer to/from the working fluid. In FIG. 6, the fin portion 42 of the fin plate 30 includes a plurality of thin slots 88. The slots 88 are designed to promote fluid flow between sub-chambers 24 and to increase turbulence within the chamber 14. The slots 88 also increase the surface area of the internal fins 22. As such, the slots 88 may increase heat transfer between the fins 22 and the working fluid. For corresponding applications, it is anticipated that the dimensions, shape, orientation and number of slots 22 may be further optimized through experimentation and/or modeling.

In the preferred embodiment described above, the displacer 16 is formed from an assembly of interchangeable flat plates configured to fit within the sub-chambers 24 between the fins 22. Such an arrangement is useful because it provides a modular engine block 12. That is, standard sizes of the fin plates 32 and chamber plates 30 may be mass produced and the engine size may be easily modified by varying the number of fin plates/chamber plates 30, 32 combinations. However, it should be appreciated that in modified embodiments, the engine block may be formed from a single or plurality of cast, extruded and/or milled blocks, which combine one or more features of the fin plates 30 and chamber plates 32 described above.

Each blade 18 of the displacer 16 has a generally half cylindrical shape and is configured to fit within the sub-chambers 24. In the preferred embodiment, the displacer is configured such that a 1/16th–1/32nd inch gap exists between the displacer 16, the fins 22 and the inner surface of the chamber plates 32 though gaps of other sizes can be used. The rotary displacer 16 also includes a hub 88, which is attached to the shaft 20. The material that forms the displacer 16 preferably has a low thermal conductivity, a low mass density, a low coefficient of aerodynamic friction and retains adequate strength at high temperatures, such as, for example, Flourocarbon polymers, Fluorosilicate polymers, Glass, Glass-Epoxy composites, High-temperature thermosetting plastics, Magnesium alloys, Aluminum alloys, and/or ceramic foams or aluminum honeycomb.

FIGS. 7A–7D illustrate several modified embodiments of a rotary displacer. These modified embodiments provide for a displacer that is substantially counter-balanced. This can increase the efficiency of the engine 10 by reducing the energy required to rotate and stop the rotary displace 16*r*. With initial reference to FIG. 7A, a rotary displacer 90 is formed from a first portion 92 made of a first material 92 (e.g., aluminum) and a second portion 94 made of a less dense second material (e.g., a closed cell foam). The first portion forms a frame with a first thickness T1 on an open side 98 of the displacer 90 and a second thickness T2 on a closed side 100 of the displacer 90. On the closed side 100, the second portion 94 fills the area between the frame 94 and a hub 101. Given the relative densities of the first and second materials 92, 94, the first and second thicknesses T1, T2 may be selected to produce a rotary displacer 90 that is balanced about a central axis 102.

Figure 7B:
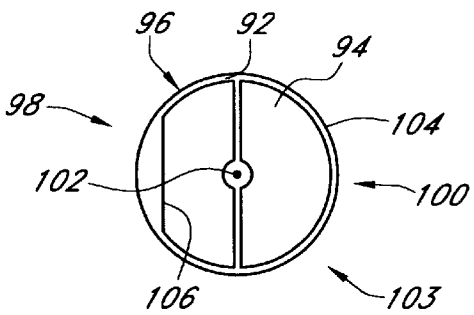
FIGS. 7A–D illustrate several modified embodiments of the displacer.
Figure 7A:
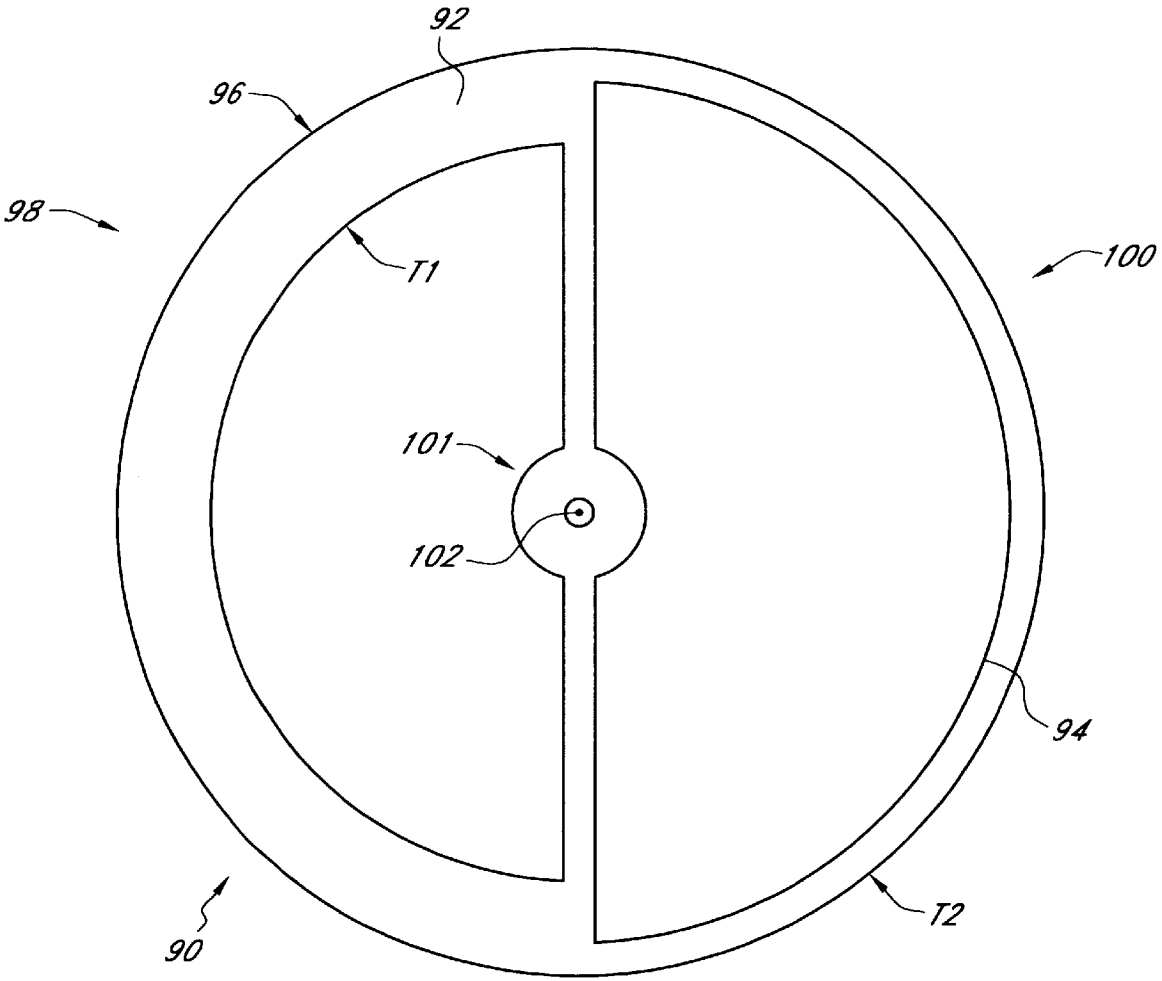

In FIG. 7B, a displacer 103 includes a frame 104 with a generally uniform thickness. To balance the displacer 90, a thick portion 106 is added to the frame 104 generally opposite the closed side 100. As with the previous embodiment, given the relative densities of the materials of the first and second portion 92, 94, the area of the thick portion 106 can be adjusted to balance the rotary displacer 90 about the central axis 102.

Figure 7D:
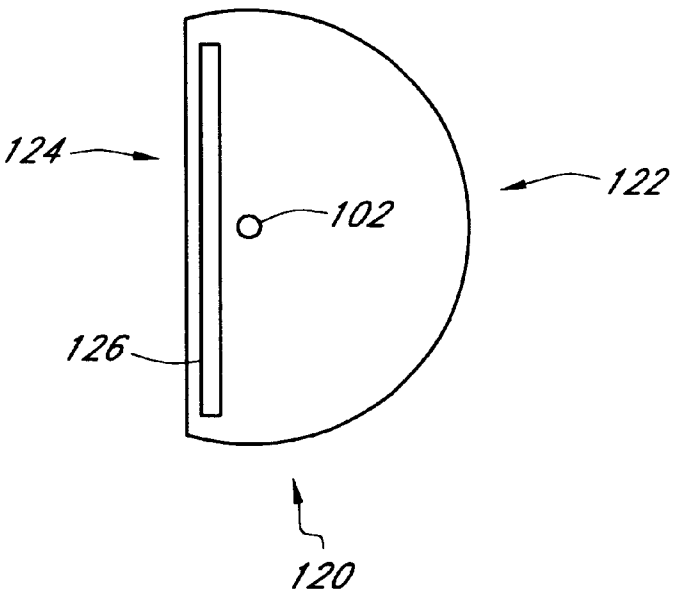
Figure 7C:
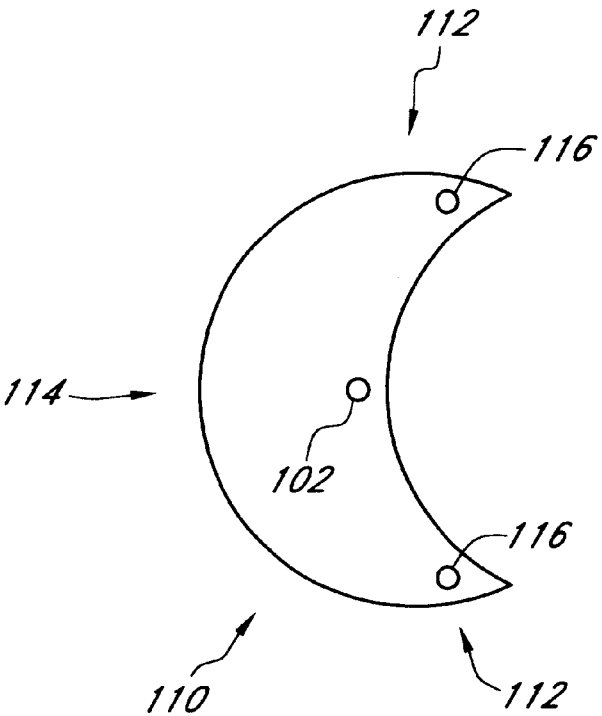

FIG. 7C illustrates another embodiment of a displacer 110. In this embodiment, the rotary displacer 110 is crescent shaped. End portions 112 of the crescent shaped displacer 110 lie on one side of the central axis 102 while a main portion 114 of the crescent lies on the other side of the central axis 102. Weight plugs 116 (i.e., a material that is denser than the main portion 114 and end portions 112) are provided on the end portions 112 to balance the rotary displacer 110.

FIG. 7D illustrates yet another embodiment of a rotary displacer 120. In this embodiment, the rotary displacer 120 has a generally half-circular shape, which includes a main portion 122 located on one side of the central axis 102 and a weight portion 124 located on the other side of the central axis 102. The weight portion 124 is wide enough to support a weight plug 126, which is used to balance the rotary displacer 120 about the central axis 102.

In other modified embodiments, the rotary displacer may be counter-balanced outside of the engine block 12. For example, in such an arrangement, the shaft 20 (see FIG. 1) may extend outside the engine block and weights may be attached to the shaft 20, generally opposite the displacer 16, to counter-balance the rotary displacer 16.

Figure 8B:
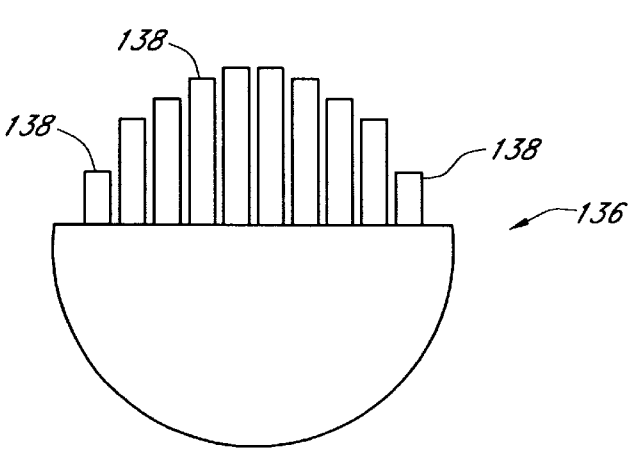
FIGS. 8A–C illustrate several more modified embodiments of the displacer.
Figure 8C:
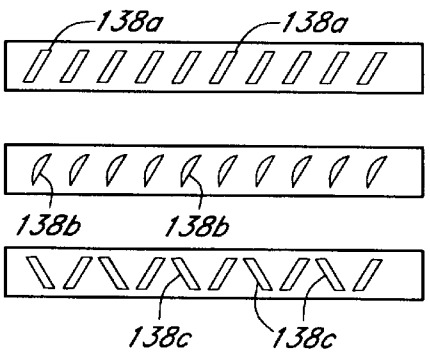
Figure 8A:
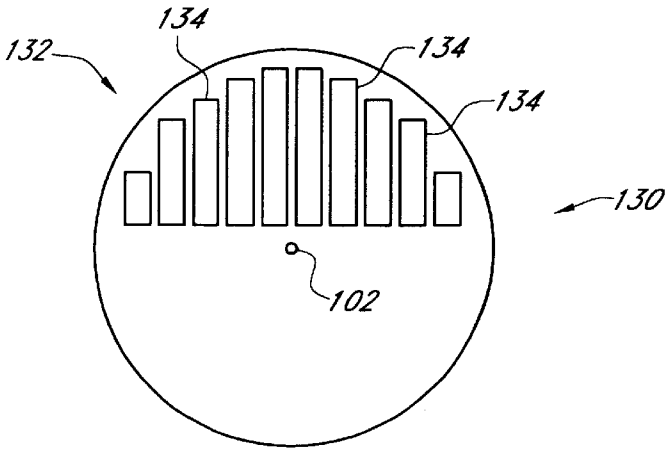

FIGS. 8A–C illustrate additional embodiments of a rotary displacer. These modified embodiments are designed to increase the heat transfer to/from the working fluid and the internal fins 22 and/or to promote the flow of working fluid between sub-chambers 24. It should also be appreciated that these embodiments can also be used in combination with the embodiments described above with reference to FIGS. 7A–D.

With initial reference to FIG. 8A, a rotary displacer 130 has generally circular shape. One half 132 of the displacer includes a plurality of wide slots 134. These slots 134 are designed to increase turbulence in the working fluid and thereby increase heat transfer between the working fluid and the internal fins 22. A rotary displacer 136 in FIG. 8B includes a plurality of blades 138, which are designed to perform the same function as the slots 134 of FIG. 8A. As shown in FIG. 8C, the blades 138*a,b,c* may be shaped and orientated in a variety of ways. For corresponding applications, it is anticipated that the dimensions, shape, orientation and number of slots 134 or blades 138 may be further optimized through experimentation and/or modeling.

With reference back to FIG. 1, the displacer drive motor 25 is provided for rotating the displacer 16. The displacer drive motor may 25 be of any suitable type, such as, for example, a DC servo motor or a high torque stepper motor. Preferably, the motor 25 is operatively connected to and controlled by a microprocessor.

The illustrated motor has an output shaft (not shown), which extends through the end assembly 50 and is coupled to the shaft 20. To prevent leakage of the working fluid, the connection between the motor 25 and the end assembly 50 may be suitably sealed as described above. The motor 25 preferably is enclosed within motor cover 140, which may be attached to the end assembly 50. More preferably, the interior of the motor cover 140 is pressurized to a pressure that is substantially near or above the pressure of the working fluid.

In a modified embodiment, the motor may be situated within the engine block 12. For example, the motor 25 may be situated within the shaft 20. In such an embodiment, the motor 25 preferably is wirelessly connected to the micro-processor via, by way of example, infrared or RF signals. In another embodiment, the rotary displacer 16 may be rotated via a combination of magnets and/or magnetic materials. For example, magnetic material may be placed on/in the rotary displacer 16 and the rotary displacer 16 can be rotated by alternately subjecting to the rotary displacer 16 to the force of a magnetic field. In yet another embodiment, the rotary displacer 16 can be coupled to an output shaft of a piston, which is driven by the expansion and contraction of the working fluid.

As shown in FIG. 1, the illustrated embodiment utilizes a rolling sock piston 150 to convert the expansion and contraction of the working fluid into electricity. The rolling sock piston 150 comprises a piston chamber 152, which is coupled or connected to the end assembly 50 so as to be in communication with the chamber 14, a flexible membrane 154 and a piston rod 156. The membrane 154 is attached to the interior of the chamber 152 to prevent the leakage of working fluid past the piston 150. The piston rod 156 is coupled at a first end 158 to the membrane 154. Preferably, a second end 160 of the rod 156 preferably is coupled to a transmission, flywheel and generator. These components are well known in the art and are used to convert the linear movement of the piston rod 156 to electricity.

Preferably, the piston chamber 154 is attached to the cold side 66 of the engine block 12 to reduce the heat exposure. It should be appreciated that in modified embodiments the engine 12 can include a plurality of rolling sock pistons 150 or other piston types. Moreover, the rolling sock pistons can be located at other positions on the engine 10, such as, for example, the sides of the engine block 12.

It should also be appreciated that there are many modified embodiments, which utilize different methods for converting the expansion and compression of the working fluid to electrical energy. For example, a linear alternator or voice coil generator can be used to convert the linear movement of the piston directly to electricity. In another embodiment, the expansion and contraction may be used to stress a piezoelectric material. In yet another embodiment, the expansion and contraction can be used to generate power through a reverse speaker. In such an arrangement, the reverse speaker can include a cone, which expands and contracts with the expansion and the compression of the working fluid. A voice coil is located at the apex of the cone and moves back and forth in accordance with the cone expansion and contraction. The voice coil is positioned within a magnetic field generated, by way of example, by a permanent magnet. The movement of the cone voice coil within the magnetic field causes a current to be generated in the voice coil.

In use, the drive motor 25 rotates the rotary displacer 16 to a first position, which is illustrated in FIG. 1. In this position, the rotary displacer 16 occupies the cold side 66 of the chamber 14. As such, most of the working fluid is located in the hot side 68 of the chamber 14. Heat is transferred from the heat source to the working fluid through the fins 22. This causes the working fluid to expand. As the working fluid expands, the piston is pushed to the left of FIG. 1. The movement of the piston, in turn, may be converted to electricity as described above.

The motor 25 then rotates the displacer 16 from the first position to a second position. In the second position, the displacer 16 occupies the hot side 68 of the chamber 14. As such, most of the working fluid in the hot side 68 of the chamber 14 is displaced and now occupies the cold side 66 of the chamber 14. As such, heat is transferred from the working fluid to the heat sink through the internal fins 22. This causes the working fluid to contract. As the working fluid contracts, the piston 150 is pulled to the right of FIG. 1. This movement also may be converted to electricity as described above.

Figure 9:
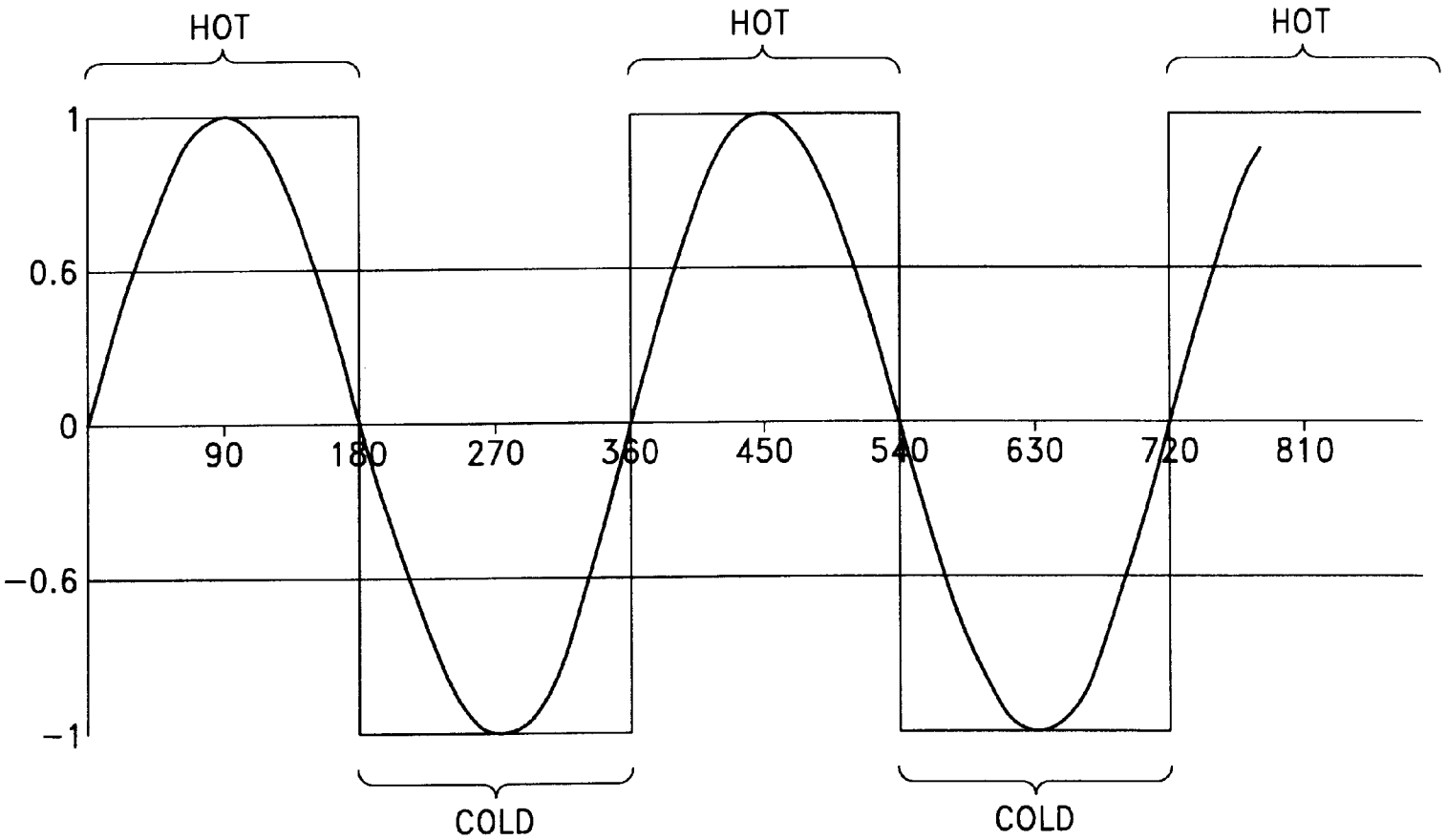
FIG. 9 is a graph that illustrates the theoretical movement of working fluid in the engine of FIG. 1.

Preferably, the rotary displacer 16 is continuously rotated between the first and second positions at a rate of approximately 100 to 1000 revolutions per minute. FIG. 9 illustrates the sinusoidal movement of the working fluid from the hot side 68 of the chamber 14 to the cold side 66. This sinusoidal movement is typical of many prior art Stirling engines. FIG. 9 also illustrates a square curve in which the working fluid is instantaneously moved from the hot side 68 to the cold side 66 of the chamber 14. In terms of theoretical thermodynamic efficiency, this represents the ideal movement of the working fluid. However, to produce such a square curve would dramatically increase aerodynamic drag and require large amounts of energy to move and stop the rotary displacer 16. Therefore, the costs associated with the square curve must be balanced with respect to the thermodynamic advantages.

In the illustrated embodiment, the displacer 16 can be precisely controlled by the drive motor 25. For example, the rotational speed of the displacer 16 can be varied within a single revolution. Such precise control of the movement of the displacer 16 is not possible with many prior art Stirling engines. Because the illustrated embodiment provides for such precise control, the motion of the displacer 16 can be varied from the typical sinusoidal movement and optimized using a general or special purpose, computer, or neural net using, by way of example, a predictive adaptive method and/or fuzzy logic algorithm. Preferably, this involves varying the motion of the displacer 16 and using a feedback loop that utilizes measurements of system performance and/or models. For example, (i) a table can be used to lookup the next position and/or velocity of the displacer given the current piston position and/or velocity and/or displacer shaft position and velocity, (ii) a finite-state machine can be used to yield the next displacer positioned and/or velocity a based on the current engine state, (iii) an equation can be used that yields the next displacer position as a function of displacer velocity, current displacer position and/or piston position and (iv) an equation, which synchronizes displacer phase and piston phase with desired generator power output, current wave form phase and frequency can also be used.

For corresponding applications, several other features of the engine can be further optimized using experimentation and/or modeling. For example, the aerodynamic shape of the rotary displacer may be further optimized to minimize drag, reduce/enhance turbulence, conductive heat transfer and/or convective heat transfer. The width of the blades, the rotary displace and/or the fins also may be further optimized with respect to, by way of example, the efficient expansion/contraction of the working fluid, movement of the working fluid between hot and cold segments the engine, the thermal transfer and rate of thermal transfer between the fins, the engine block, and the working fluid.

An important design parameter is the pressure of the working fluid. In general, increasing the pressure of the working fluid increases the thermal efficiency of the engine. Of course, the pressure of the working fluid must be balanced against, for example, safety and the costs and mechanical complexity of sealing the engine. In one preferred embodiment, the working fluid is at a pressure greater than approximately 20 atmospheres.

The working fluid itself preferably has a low coefficient of aerodynamic friction, a low viscosity, a high thermal conductivity, a high coefficient of thermal expansion and is non-reactive with other engine materials, such as, for example, Air, Helium, Hydrogen and Argon. Other embodiments use a liquid-gas phase-changing working fluid with boiling points within the operating range of the engine, such as, for example, Water, fluorocarbons and commercial refrigerants.

Figure 10:
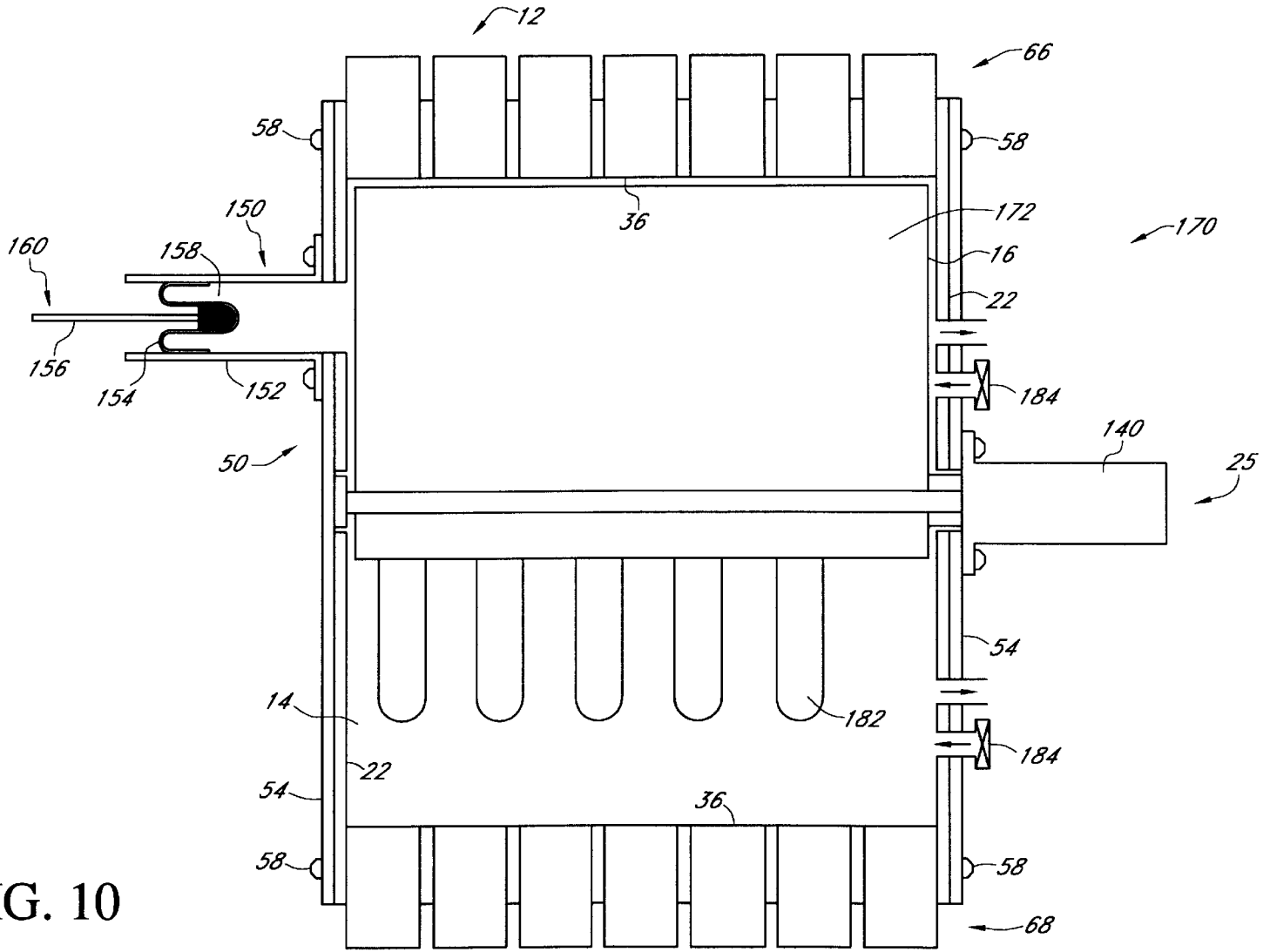
FIG. 10 is a cross-sectional view of another modified embodiment of the engine of FIG. 1.

FIG. 10 illustrates another embodiment of a rotary Stirling engine 170. In this embodiment, a single rotary displacer 172 is positioned within an engine block 174. The engine block 176 defines a chamber 178, which is not divided into sub-chambers by internal fins. As such, heat is transferred to/from the working fluid through the side walls 180 of the engine block 176.

As shown in FIG. 10, the rotary displacer 172 may include turbulence generators 182, which in the illustrated arrangement comprise a plurality of blades. The turbulence generated by the turbulence generators promote more efficient heat transfer to/from the engine walls 180. The illustrated embodiment also includes a pair of fans 184, which force/pull air across the hot and cold sides 68, 66 of the chamber 178.

Figure 13:
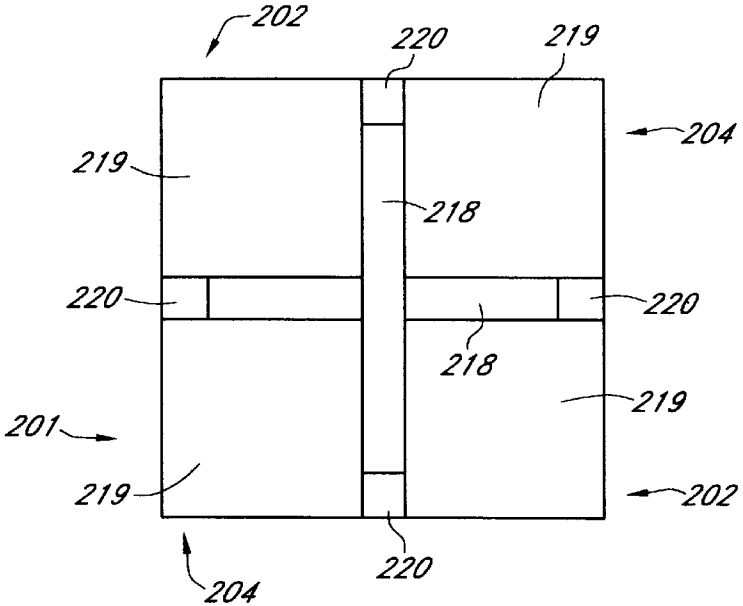
FIG. 13 is a modified embodiment of the fin plate of FIG. 12A.
Figure 12B:
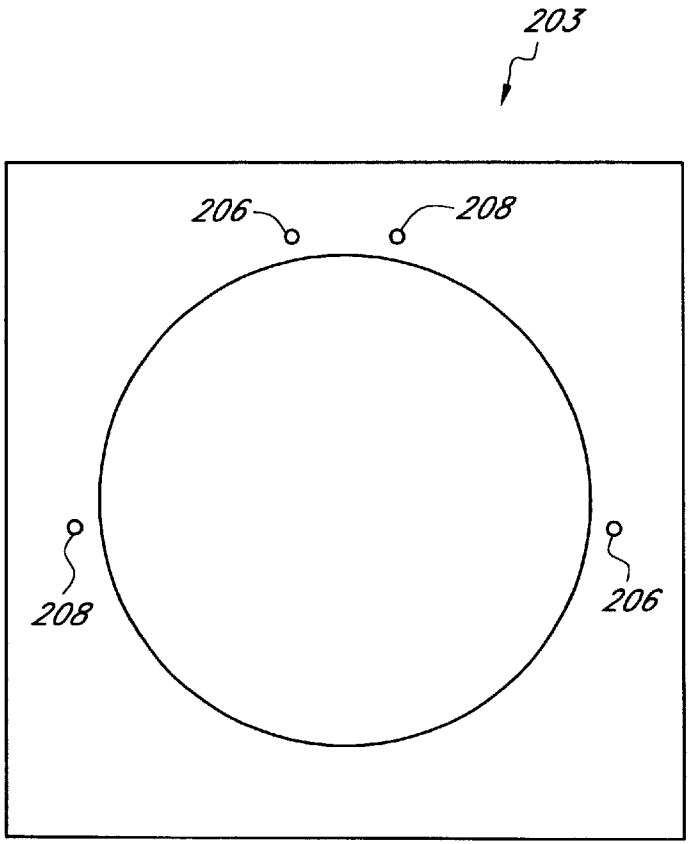
FIGS. 12A–B illustrate the fin plates, chamber plates, cold passages and hot passages of the engine of FIG. 11.
Figure 12A:
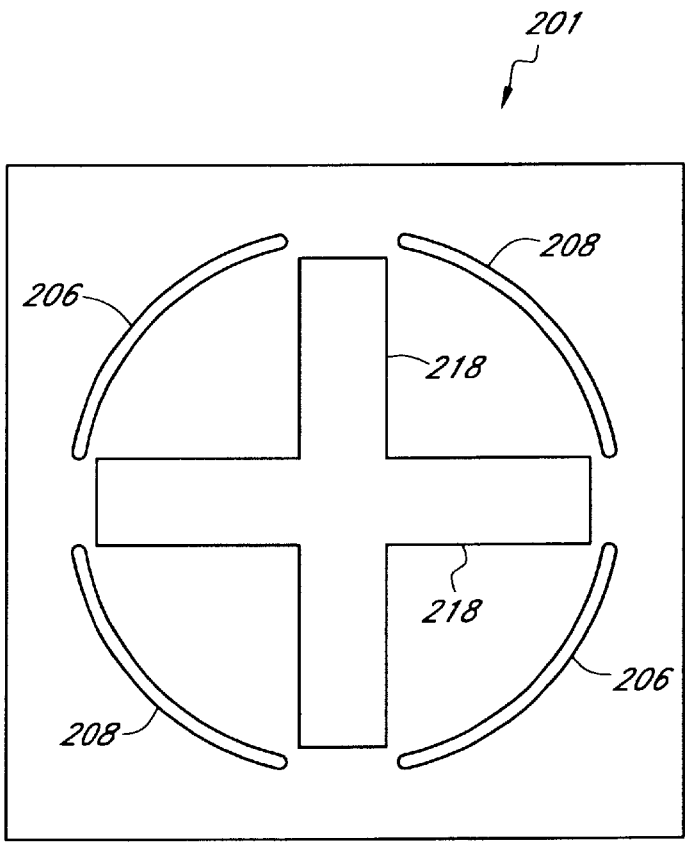

FIGS. 11 and 12A–C illustrate an embodiment of a four-quadrant Stirling engine 200 having certain features and advantages according to the present invention. In this embodiment, the engine 200 includes an engine block 201 formed by a series of fin plates 203 and chamber plates 205. The engine block 201 has two cold corners 202 and two hot corners 204. The cold corners 202 are cooled by cooling passages 206 and the hot corners 204 are heated by heating passages 208 (see FIG. 12A) formed in the fm plates 203 and chamber plates 205. A rotary displacer 210 is positioned within the engine block 201 and includes a first lobe 212 and a second lobe 214, which fill opposite corners of a chamber 216, which is defined by the engine block 201. To prevent heat transfer between the quadrants, the fin plates 201 are provided with a pair of slots 218, which partially separate the corners. In a modified arrangement that is illustrated in FIG. 13, each corner 219 is a separate piece, which is separated from the other corners by insulating material 220. One advantage of the four-quadrant Stirling engine 200 is that the rotary displacer 210 is balanced about a central axis 222 of the engine 200.

Figure 11:
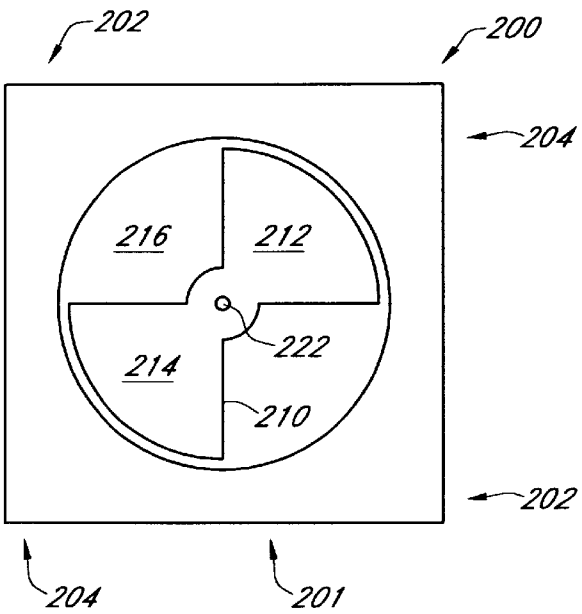
FIG. 11 is a top view of a second embodiment of a Stirling engine.

It should be appreciated that many of the modified embodiments described above with respect to the rotary Stirling engines 10, 80, 170 can also be applied to the four-quadrant Stirling engine of FIGS. 11–13.

Figure 14B:
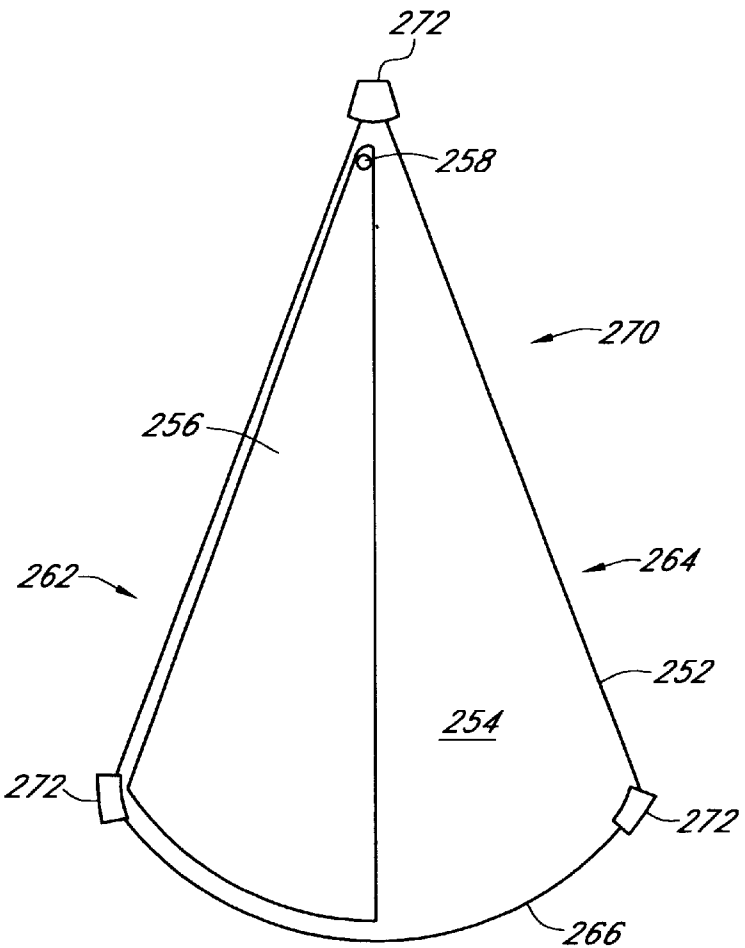
FIG. 14B is a modified embodiment of the engine of FIG. 14A.
Figure 14A:
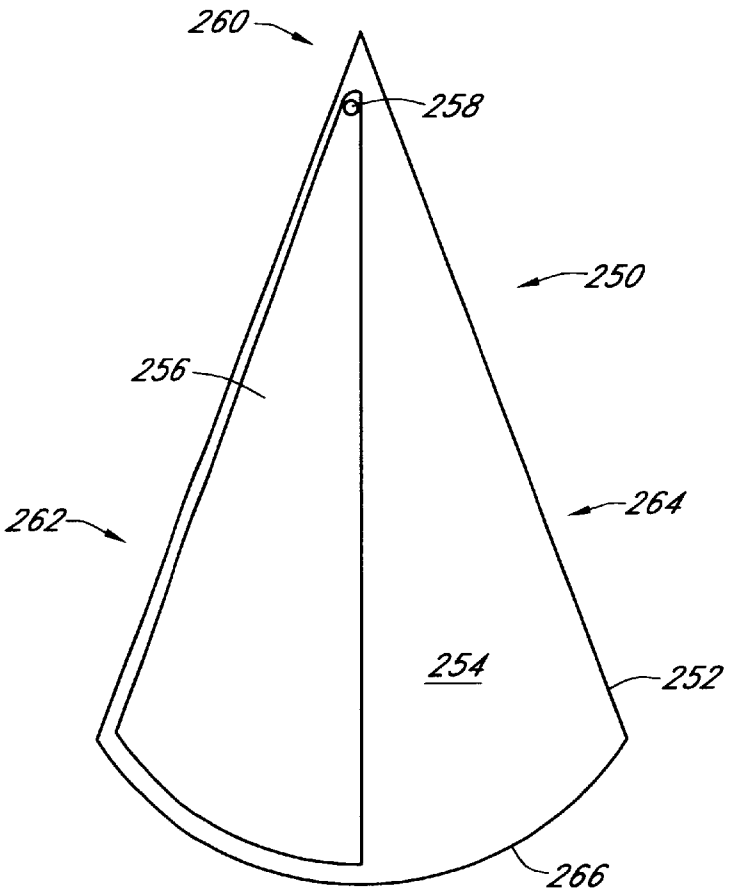
FIG. 14A is a side elevational view of a third embodiment of a Stirling engine.

FIG. 14A is a schematic cross-sectional view of an embodiment of a pendulum Stirling engine 250 having certain features and advantages according to the present invention. In this embodiment, the Stirling engine 250 comprises an engine block 252 that has a generally triangular cross-section. The engine block 252 defines a chamber 254 for the working fluid. A pendulum displacer 256 is positioned in the chamber 254 and is journalled for reciprocal motion about a pivot axis 258, which is positioned at one apex 260 of the engine block 252. The displacer 256 is generally configured to occupy half of the chamber 254. The engine block 252 has a hot side 262 and a cold side 264, which can be heated or cooled in several different ways as described above. For example, cooling and heating passages can be formed in the walls of the engine block 252 and/or the walls of the engine block 252 can be exposed directly to a heat sink and/or heat source. Between the hot side and the cold side is a base 266, which may be curved, as illustrated, or flat. One or more rolling sock pistons (not shown) may be positioned on the base 266 or any other suitable location for capturing the energy from the expansion and contraction of the working fluid as the pendulum displacer 256 is moved back and forth within the chamber 254.

FIG. 14B illustrates a modified embodiment of a pendulum Stirling engine 270. In this embodiment, the cold side 264, hot side 262, and base 266 are separated by an insulating material 272. This reduces heat transfer between the cold side 264 and hot side 262.

As with the four-quadrant engine, it should be appreciated that many of the modified embodiments described above with respect to the rotary Stirling engine can also be applied to the pendulum Stirling engine of FIGS. 14A and 14B. For example, the engine block can be formed from a series of chamber plates and fin plates, which define a plurality of sub-chambers. In such an arrangement, the pendulum displacer can include a plurality of blades positioned within the sub-chambers. In another example, the pendulum displacer can include blades and/or slots to promote turbulence and heat transfer to/from the working fluid.

Figure 15B:
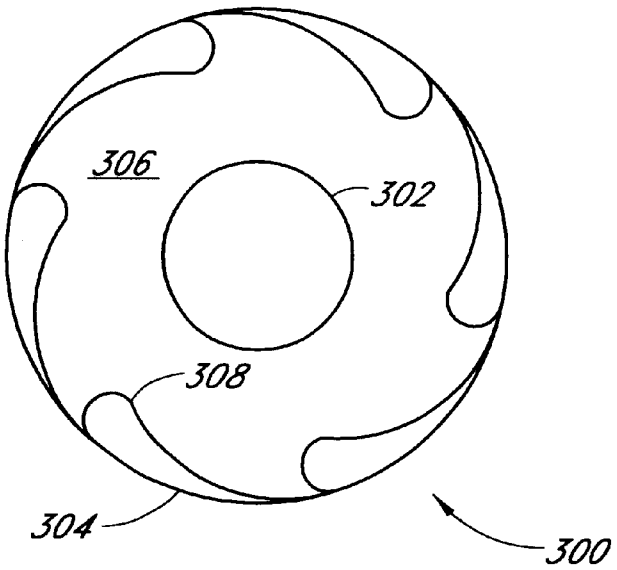
FIGS. 15A–B are top plan views of a fourth embodiment of a Stirling engine.
Figure 15A:
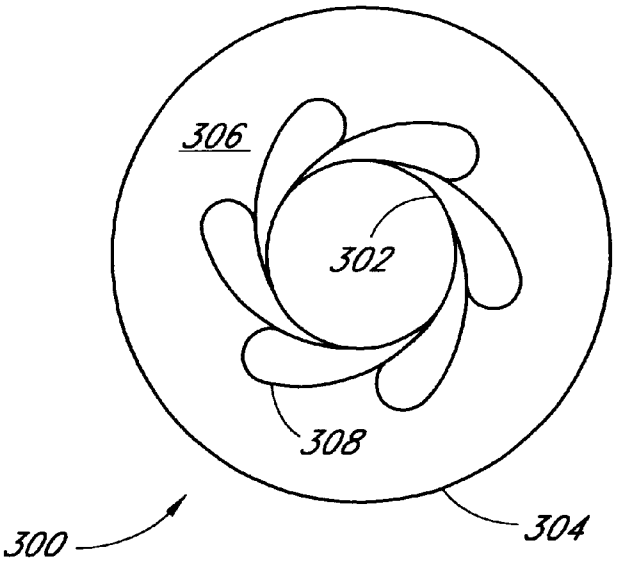

FIGS. 15A and 15B illustrates an embodiment of a radial Stirling engine 300 having certain features and advantages according the present invention. As shown in FIG. 15, the engine block comprises a inner cylinder 302 and an outer cylinder 304. The space between the two cylinders defines a chamber 306 for the working fluid. In this arrangement, the inner cylinder 302 is the hot side of the Stirling engine 300 while the outer cylinder 304 is the cold side of the engine 300. An iris-type displacer 308 is used to alternately expose the working fluid to the cold side 304 and the hot side 302. In a modified arrangement, the outer cylinder 304 may be the hot side and inner cylinder 302 may be the cool side. The working fluid is alternately expanded and contracted by expanding and contracting the iris displacer 308. In the position shown in FIG. 15A, the displacer 308 is contracted and most of the working fluid is in contact with the cold side 304 of the engine 300. In the position shown in FIG. 15B, the displacer is expanded and most of the working fluid is in contact with the hot side 302 of the engine.

As with the previous embodiments, it should be appreciated that many of the modified embodiments described above with respect to the rotary Stirling engine can also be applied to the radial Stirling engine of FIGS. 15A–B.

Figure 16:
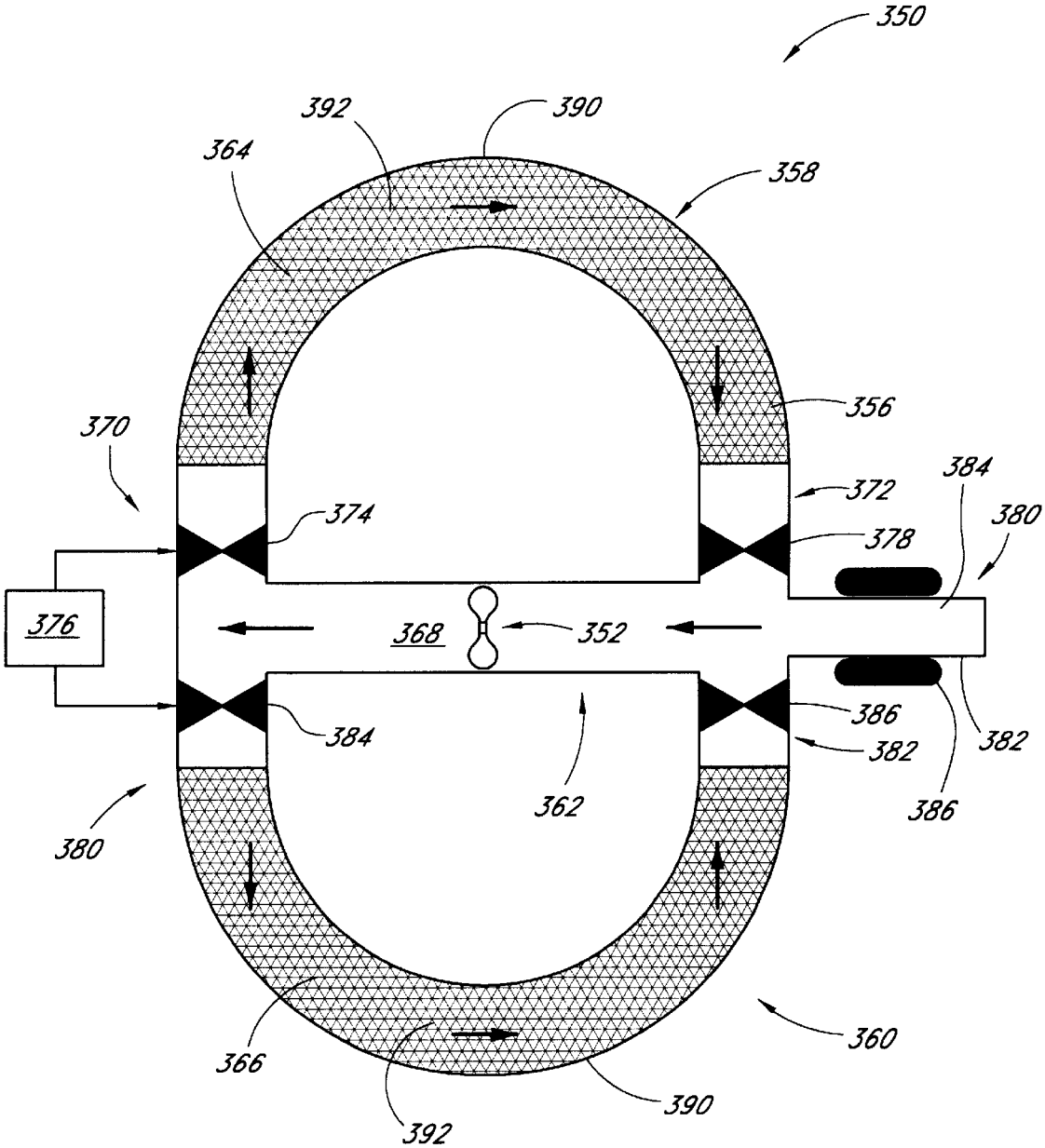
FIG. 16 illustrates a fifth embodiment of a Stirling engine.

FIG. 16 illustrates another embodiment of a Stirling engine 350 having certain features and advantages according to the present invention. This embodiment uses an air circulator 352 instead of a displacer to move the working fluid from a cold side 360 of the engine 350 to a hot side 358 of the engine 350. As shown in FIG. 16, the engine 350 includes an engine block 356, which comprises the hot side 358, a the cold side 360 and a working fluid section 362. As explained above, the hot side is 358 exposed to a hot thermal source and the cold side 360 is exposed to a thermal sink.

The hot side 358, cold side 360 and working fluid section 362 respectively define a hot path 364, a cold path 366 and a working fluid space 368. The hot path 364 is connected to the working fluid space 368 by an inlet 370 and an outlet 372. The inlet 370 includes an inlet valve 374, which, in the illustrated embodiment, is an active valve, such as, for example, electromechanical or pneumatic valve. The active valve 374 preferably is operatively connected to and controlled by a control system 376, which, by way of example, can be based on a microprocessor as discussed above. The outlet 372 includes an outlet valve 378, which, in the illustrated embodiment, is a passive valve 378, such as, for example, a check valve. The passive valve 378 is configured to allow working fluid to flow from the hot path 364 into the working fluid space 368 while preventing working fluid from flowing into the hot path 364 from the working fluid space 368. In modified embodiments, the inlet valve 374 can be passive while the outlet valve 378 is active. In another embodiment, both the inlet and the outlet valves 374, 378 may be active or only one active valve may be provided in the hot path 364. It should also be appreciated that the valves 374, 378 may be moved upstream and/or downstream from the inlet 370 and/or outlet 372.

In a similar manner, the cold path 366 is also connected to the working fluid space 368 by an inlet 380 and an outlet 382. The inlet 380 includes an inlet valve 384, which, in the illustrated embodiment, is an active valve, which preferably is operatively connected to and controlled by the control system 386. The outlet 382 also includes an outlet valve 386, which, in the illustrated embodiment, is a passive valve, such as, for example, a check valve. The passive valve 386 is configured to allow working fluid to flow from the cold path 366 into the working fluid space 368 while preventing working fluid from flowing into the cold path 366 from the working fluid space 368. As with the hot path 364, in modified embodiments, the inlet valve 384 may be passive while the outlet valve 386 is active. In other embodiments, both the inlet and the outlet valves 384, 386 can may be active or only one active valve may be provided in the cold path 366. Moreover, the valves 384, 386 may be moved upstream and/or downstream from the inlet and/or outlet.

In one embodiment, the hot side 358 and the cold side 360 are formed from U-shaped pipes 390. In such an embodiment, each end 392 of the U-shaped pipe corresponds to an inlet 370, 380 and an outlet 372, 382 respectively. In some embodiments, the hot and/or cold side 358, 360 may be formed from a single or plurality of cast, extruded and/or milled blocks that are made, by way of example, stainless steel and/or copper. In other embodiments, the hot and/or side 358, 360 may be formed from sheets of material that are bent and welded together.

Preferably, the working section 362 is insulated from the hot and cold sides 358, 360 of the engine 350 and the volume of the working section 362 is significantly larger either than the volume of the hot and/or cold paths 364, 366. A working fluid circulator 352, such as, for example a fan, impeller and/or pump, is preferably positioned within the working fluid space 368. As will be explained in more detail below, the working fluid circulator 352 is configured to move the working fluid alternately through the hot path 364 and the cold path 366. In modified embodiments, the engine 350 may include a plurality of air circulators. In such an arrangement, the air circulators can be located, by way of example, in the hot path 364, the cold path 366, and /or the working fluid space 368. The air circulator 352 preferably is operated in a continuous manner although in modified embodiments the air circulator 352 can be intermittently operated.

The illustrated embodiment utilizes a linear alternator piston 380 to convert the expansion and contraction of the working fluid into electricity. The linear alternator piston 380 comprises a piston chamber 382 that is connected to the working fluid space 368. A piston 384 is suitably journalled for movement within the chamber 382. As such, the piston 384 moves back and forth with the expansion and contraction of the working fluid. By way of example, a permanent magnet is provided on the piston 384 for generating a magnetic field and a coil 386 is provided around the piston chamber 382. Thus, the movement of permanent magnet on the piston causes a current to be generated by the coil 386. Of course, as mentioned above, there are many modified embodiments, which may utilize different methods for converting the expansion and compression of the working fluid to electrical energy. To transfer heat to/from the working fluid in the hot and cold fluid paths 364, 366, both the hot side 358 and the cold side 360 preferably include heat exchangers 392, such as, by way of example, internal fins that extend from the walls of the engine 350 into the hot or cold paths 364, 366 or a fibrous material (e.g., a copper wool). In other embodiments, heat can be transferred to/from the working fluid through the walls of the engine block 352.

In use, the working fluid is circulated within the engine by the air circulator 352. In a first position, the valve control system 376 the inlet valve 374 to the hot path 364 is open and the inlet valve 384 to the cold path 366 is closed while the check valves 378, 386 prevent the flow of working fluid into the outlets 356, 382 of the hot and cold paths 364, 366. As such, in this position, most of the working fluid is circulated through the hot path 364 and heat is transferred from the heat source to the working fluid through the heat exchanger 392. This causes the working fluid to expand. As the working fluid expands, the piston is pushed to the right of FIG. 16. The movement of the piston, in turn, may be converted to electricity as described above.

The valve control system 376 then closes the inlet valve 374 to the hot path 364 and opens the inlet valve 384 to the cold path 366 while the check valves 378, 386 continue to prevent the flow of working fluid into the outlets 372, 382 of the hot and cold paths 364, 366. As such, in this second position, most of the working fluid is circulated through the cold path 366. As such, heat is transferred from the working fluid to the heat sink through the heat exchanger 392. This causes the working fluid to contract. As the working fluid contracts, the piston 384 is pulled to the left of FIG. 16. This movement also maybe converted to electricity as described above.

In a manner similar to the rotary displacer described above, the timing of the opening and closing of the inlet valves 374, 384 can be further optimized using a general or special purpose computer, or neural net using, by way of example, a predictive adaptive method and/or fuzzy logic algorithm. In a similar manner, the volume of working fluid circulated by the working fluid circulator 352 can also be further optimized.

Figure 17:
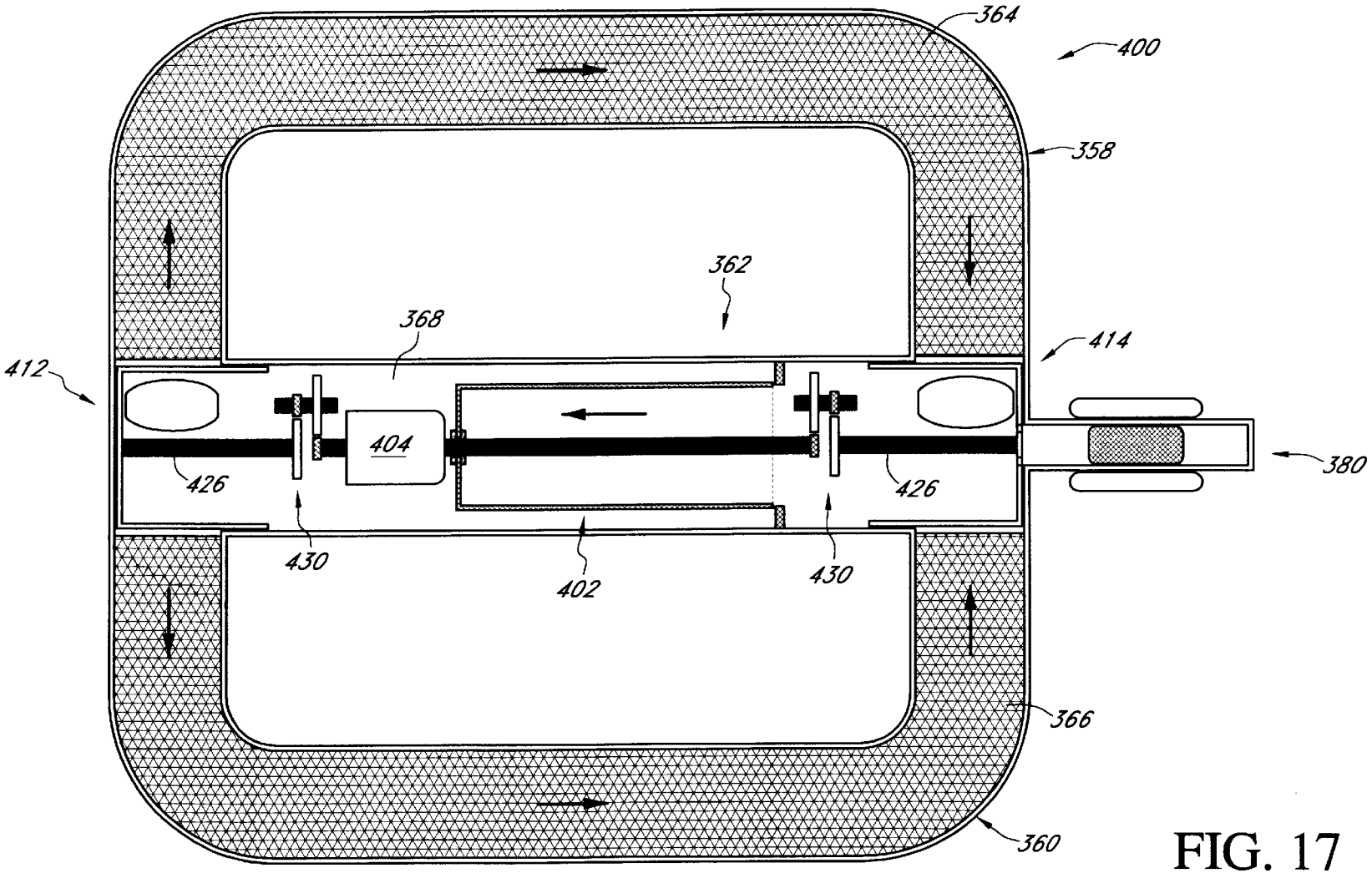
FIG. 17 illustrates a modified embodiment of the engine of FIG. 16.
Figure 18:
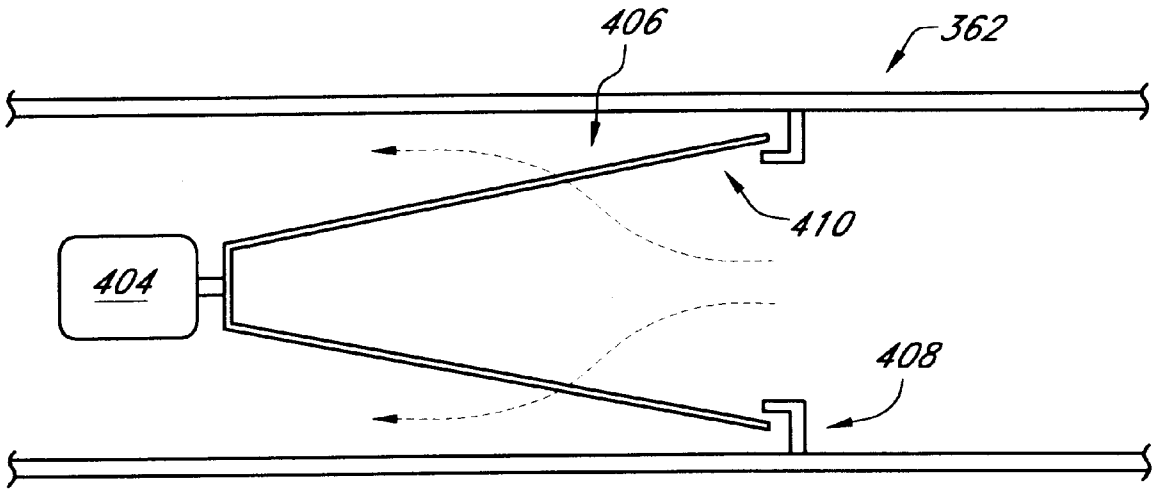
FIG. 18 illustrates a modified embodiment of an air circulator for the engine of FIG. 17.

FIG. 17 illustrates another modified embodiment of a Stirling engine 400 that uses an air circulator 402 instead of a displacer to move the working fluid from the cold side 360 of the engine to the hot side 358 of the engine 400. In FIG. 17, the same reference numbers will be used to describe components substantially similar to components shown in FIGS. 16. In this embodiment, the air circulator 402 is a deep impeller squirrel cage fan. The fan 402 is driven by a motor 404, which may be located within the working fluid space 368. In a modified embodiment, which is shown in FIG. 18, a deep impeller conical squirrel cage fan 406 can be used as the air circulator 402. An annular port 408 is preferably located at an inlet 410 of the fan 406 to prevent working fluid from bypassing the fan 406.

Figure 19:
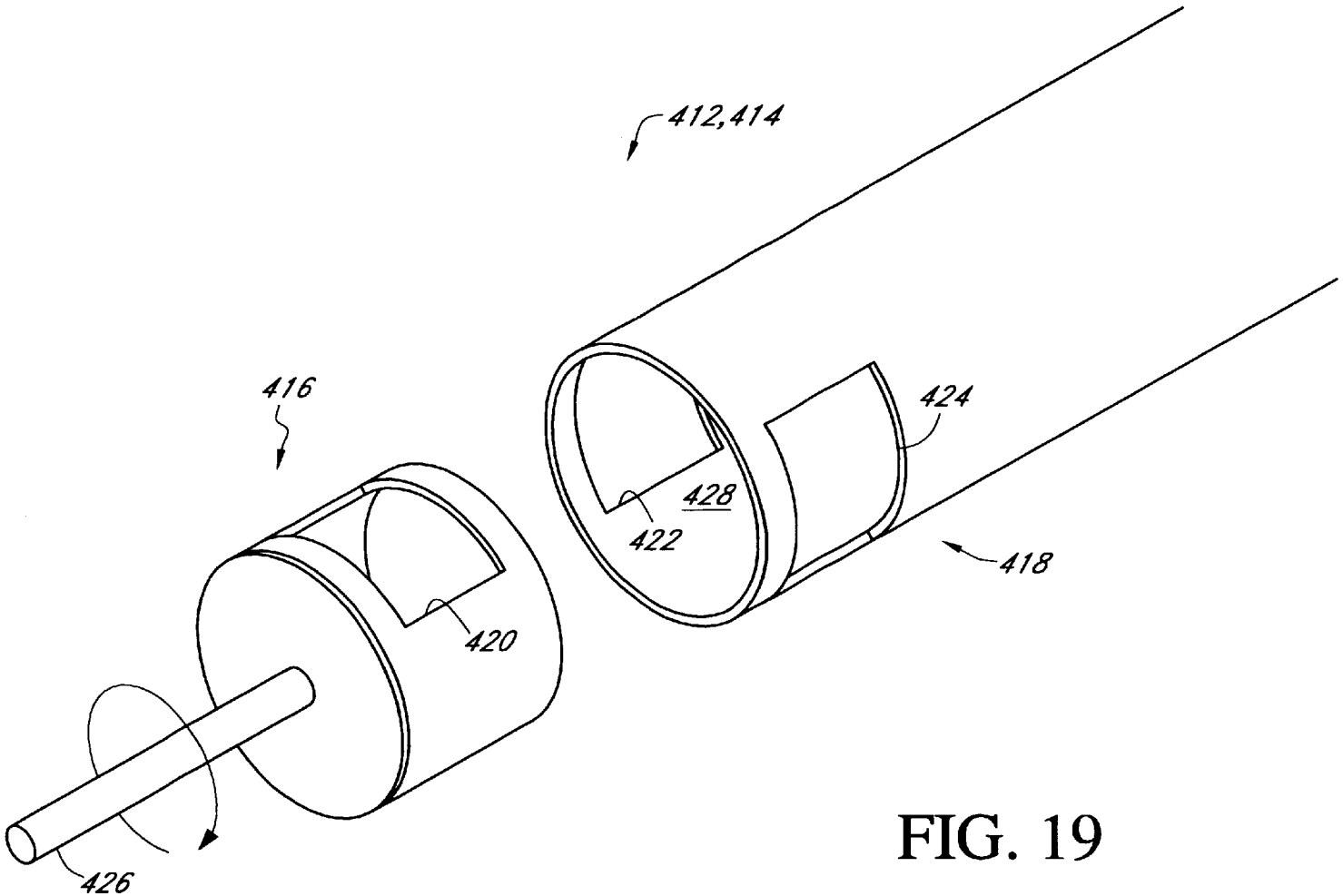
FIG. 19 illustrates a rotor valve for the engine of FIG. 17.

In the embodiment illustrated in FIG. 17, the inlet and outlet valves for the hot and cold path 364, 366 are replaced with two rotor valves 412, 414, which are also shown in FIG. 19. As shown in FIG. 19, the rotor valves 412, 414 comprise a hollow, cup-shaped, rotor portion 416, which fits inside a hollow stator portion 418. The rotor portion 416 includes a passage 420 while the stator portion includes first and second passages 422, 424. Although the illustrated passages 420, 422, 424 are square, they may be formed into other shapes, such as, for example, a circle.

The rotor portion 416 is connected to a rotor shaft 426 such that rotor portion 416 can be rotated with respect to the stator portion 418. As such, the first and second passages 422, 424 of the stator portion 418 can be alternately covered and opened. Preferably, the first passage 422 is in communication with the hot path 364 while the second passage 424 is in communication with the cold path 366. Correspondingly, an interior space 428 of the stator portion is in communication with the working fluid space 368. In this manner, by opening and closing the first and second passages 422, 424, the working fluid in the working fluid space 368 can be alternately directed to the hot path 364 and the cold path 366.

With reference back to FIG. 17, the rotor shaft, in the illustrated embodiment, is rotated by the same motor 404 that powers the working fluid circulator 404. A gear arrangement 430 (e.g., elliptical and/or half gear) can be used to control the timing of the opening and closing of the first and second passages 422, 424. In modified embodiments, either or both of the rotor valves 412, 414 may be controlled by a separate motor. In another modified arrangement, the outlet valves 412, 414 of the hot and cold paths 364, 366 may be replace by a passive valve or an active valve.

As with the previous embodiments, it should be appreciated that many of the modified embodiments described above can also be applied to the radial Stirling engine of FIG. 16 or 17.

Figure 20:
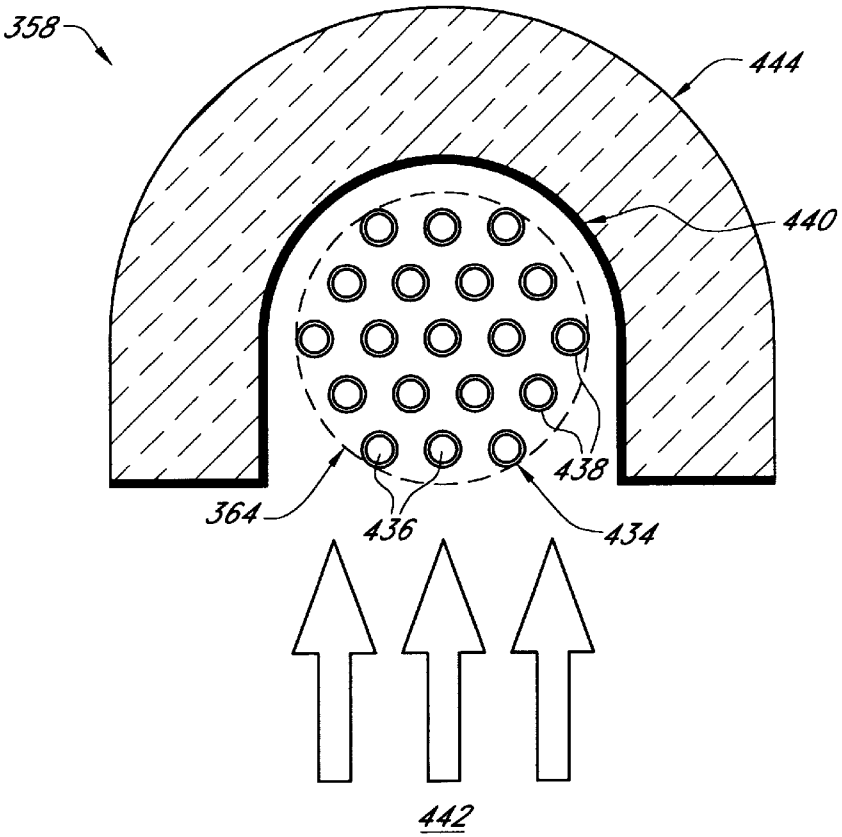
FIG. 20 illustrates a modified embodiment of a portion of the engine of FIG. 16 or 17.

FIG. 20 shows a modified embodiment of the hot path 364 for the Stirling engines 350, 400 of FIG. 16 or 17. In this embodiment, the hot path 364 includes a manifold portion 434 in which the hot path 364 is divided into a series of smaller paths 436. By way of example, the smaller paths 436 may be defined by a plurality of ducts and/or pipes 438, which can be made of a high thermally conductive material, such as, for example, copper. In the illustrated embodiment, the pipes 438 are bundled together in a hexagonal pattern in which each individual pipe 438 is spaced approximately ⅜ of an inch from each other. In such an embodiment, the manifold 434 is formed from 19 tubes 438 with a 0.5 inch outer diameter, which can be arranged within a 4 inch circle.

A reflector 440, which in the illustrated embodiment comprises a thin sheet of stainless steel, is positioned around at least a portion of the manifold 434. The reflector 440 is configured to reflect heat generated by a heat source 442, which, by way of example, may be a natural gas flame burner. The reflector 442 improves heat transfer to the tubes 438 furthest from the heat source 442 by reflecting radiation. A thermal insulator 444 preferably is provided on the side of the reflector 442 opposite the tube bundle (i.e., manifold) 434 to minimize heat loss.

FIGS. 21A–25B illustrate several embodiments of a regenerator 500 that can be used with the Stirling engines embodiments described above. As will be explained in more detail below, the regenerator 500 is used to store energy from the working fluid as it flows towards the cold side of the engine and gives energy to the working fluid as the working fluid flows through the regenerator 500 to the hot side of the engine. One advantage of the illustrated embodiments is that the regenerator 500 is moveable with respect to the engine. Such an arrangement conserves space and reduces the weight and complexity of the engine. The embodiments described below will be described in the context of an air circulator-type Stirling engine such as is illustrated in FIGS. 16 and 17. However, it should be appreciated that the regenerator 500 may also be used with the rotary and pendulum engines described herein and/or with other Stirling engine configurations.

Figure 21A:
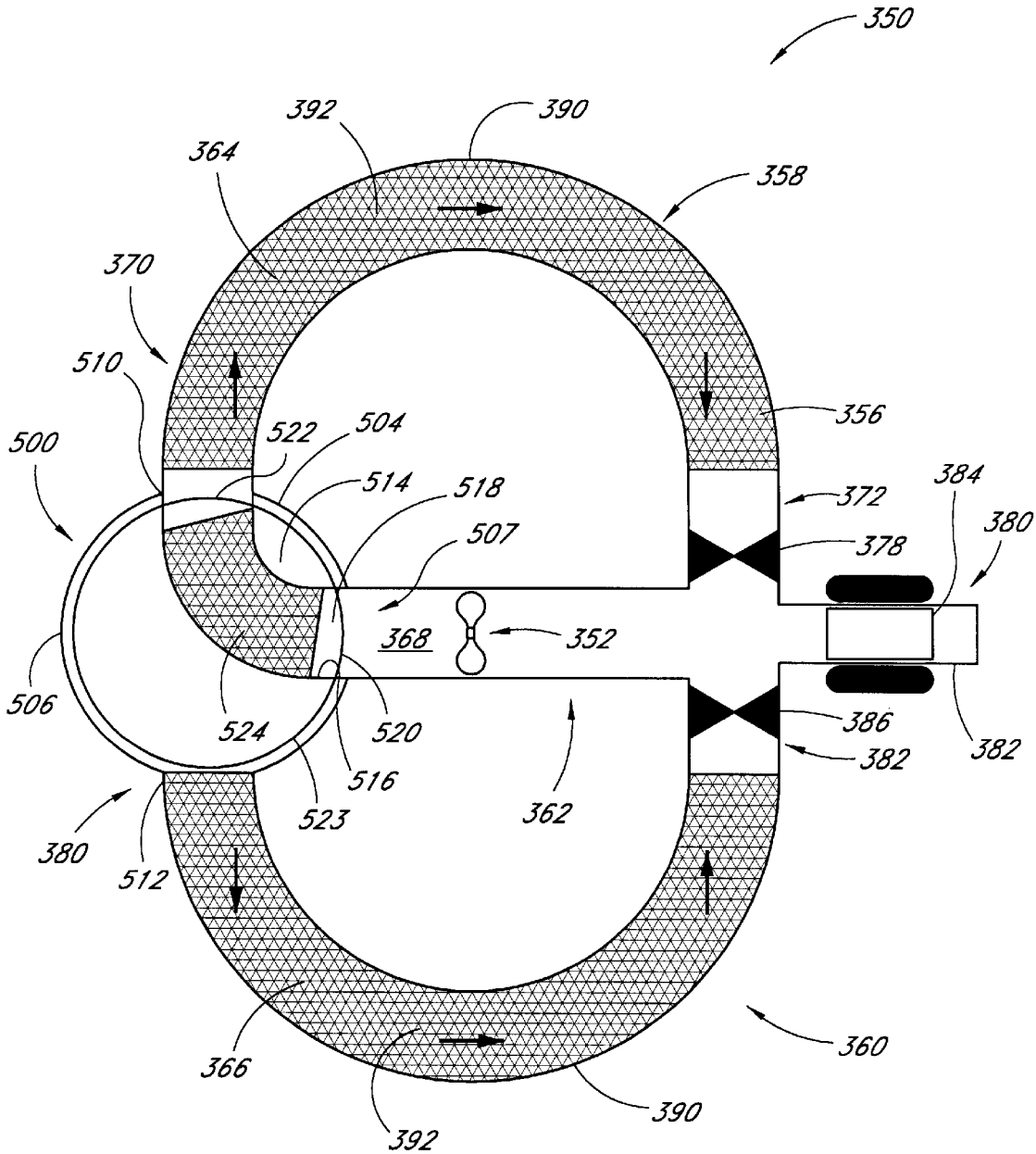
FIGS. 21A–C illustrate a regenerator having certain features and advantages according to the present invention positioned within the Stirling engine of FIG. 16.
Figure 21B:
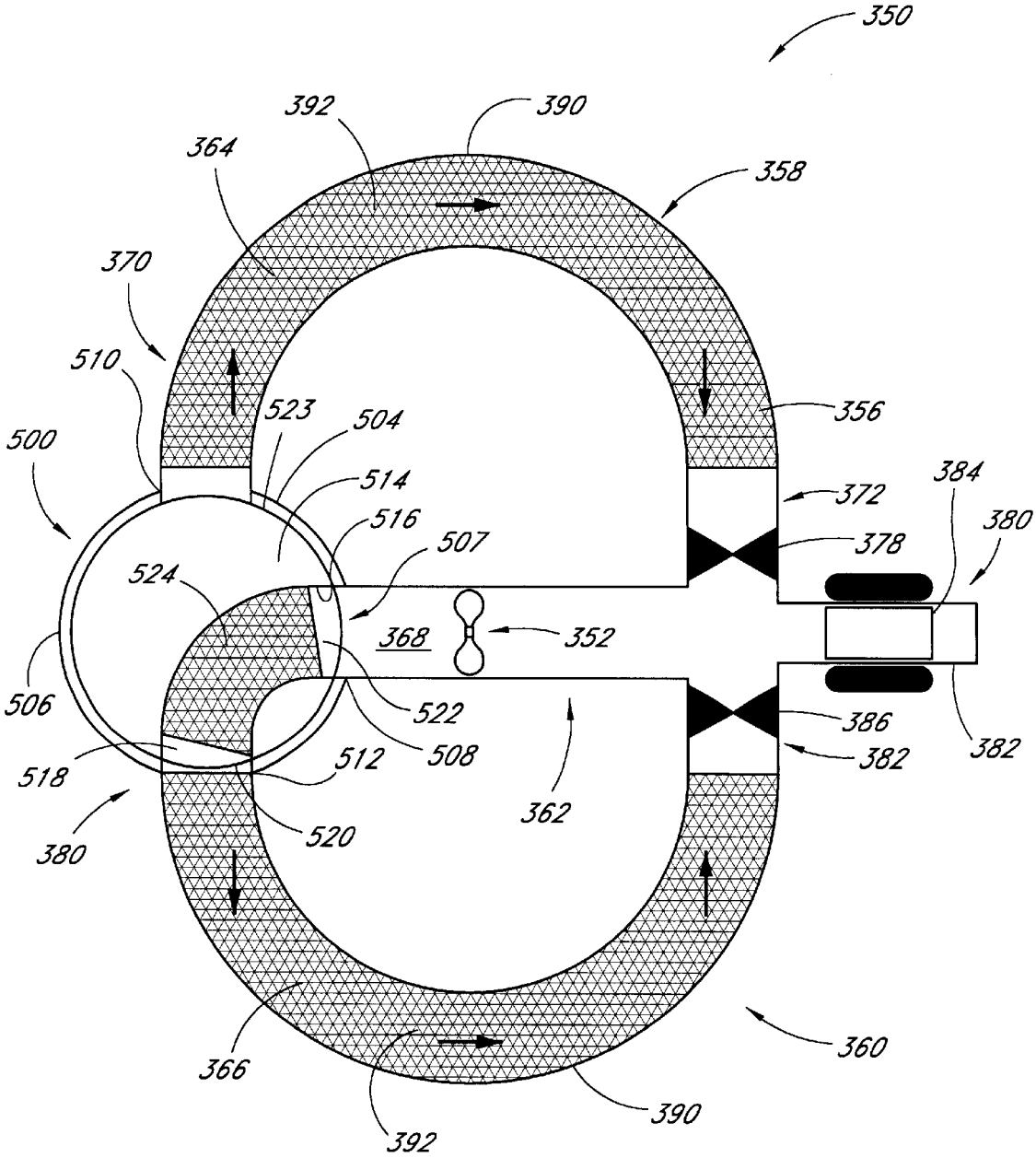
Figure 21C:
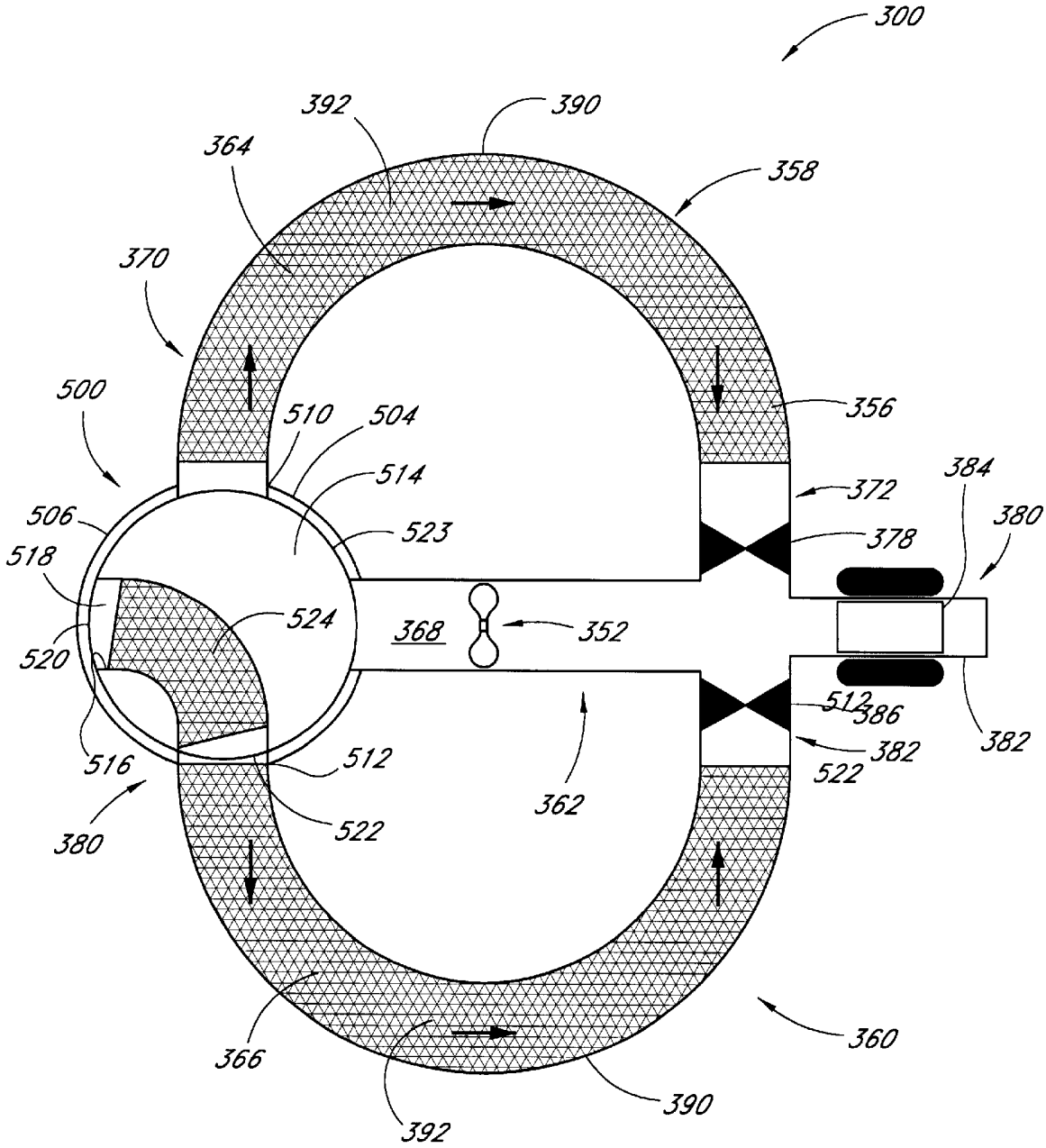

FIGS. 21A–C illustrate one embodiment of a regenerator 500 positioned within the Stirling engine 350 of FIG. 16. In the illustrated embodiment, the regenerator 500 is positioned at an outlet 502 of the working fluid space 368 and is configured to alternately direct working fluid to the inlets 370, 380 of the hot and cold paths 364, 366.

The regenerator 500 comprises a valve housing 504, which defines a generally circular valve chamber 506. The valve housing 504 includes first 508, second 510 and third openings 512, which place the working fluid space 368, the hot fluid path 364 and the cold path 366 each in communication with the valve chamber 506. A generally cylindrical valve 514 is positioned within the valve housing 504 and is journalled for movement within the valve housing 504. Specifically, the valve 514 is journalled for rotation between at least a first position illustrated in FIG. 21A and a second position illustrated in FIG. 21B. More preferably, the valve 514 is also journalled for rotation between a third position illustrated in FIG. 21C. Most preferably, the valve 514 can be rotated 360 degrees within the valve housing 504 in an oscillating manner or continuously in one direction. In one embodiment, an electric motor can be coupled to the valve 514 to rotate the valve 514. In another embodiment, the valve 514 can be coupled by to the piston by a gear arrangement. In still another arrangement, the valve 514 can be rotated by a combination of magnets.

The valve 514 includes an inner surface 516, which defines a flow path 518 that has a first end 520 and a second end 522 positioned on an outer cylindrical surface 523 of the valve 514. As shown in FIG. 21A, in the first position, the valve 514 is configured to place the working fluid space 368 in communication with the hot path 364. That is, in the first position the first end 520 is aligned with the first opening 508 and the second end 522 is aligned with the second opening 510. In this manner, the rotary regenerator 500 directs working fluid from the working fluid space 368 to the hot path 364.

The valve can be rotated in the direction of arrow A from the first position to the second position (see FIG. 21B). In the second position, the second side 522 of the flow path 518 is aligned with the first opening 508 and the first side 520 is aligned with the third opening 512. In this manner, the regenerator 500 directs working fluid from the working fluid space 368 to the cold path 366.

As mentioned above, the regenerator 500 can be configured to rotate to a third position, which is illustrated in FIG. 21C. In this position, the first and second sides 520, 522 of the flow path 518 are not aligned with the openings 508, 510, 512 or are aligned with only one of the openings 508, 510, 512 as in the illustrated embodiment. In this manner, the working fluid cannot flow through the regenerator 500.

The regenerator 500 preferably includes a heat absorber/transfer device 524 that is configured to absorb heat from the working fluid as it flows from the working space 368 to the cold path 366 and to heat the working fluid as it flows from the working space 368 to the hot path 364. The heat absorber/transfer device 524 can be formed in a variety of ways. In the illustrated embodiment, the heat absorber/transfer device 524 comprises a matrix of a material that has a high thermal conductivity and a high heat capacity, such as, for example, copper. In one preferred embodiment, the heat absorber/transfer device is a fibrous material (e.g., a copper wool) In other embodiments, internal fins can be placed within the path 518 and the valve 514.

When the regenerator 500 is initially rotated to the first position (FIG. 21A), the cold working fluid absorbs heat as it passes through the heat absorber/transfer device 524. As will be apparent from the description below, the heat absorber/transfer device is generally colder near the first end 520 as compared to the second end 522. As such, the working fluid is gradually heated as it flows from through the regenerator 500.

When the regenerator 500 is rotated to the second position from the first position, the second end or hotter end 522 of the valve 514 is aligned with the working fluid space 368 and the first or colder end 520 is aligned with the cold path 366. As such, hot working fluid, which is now directed to the cold path 366 is gradually cooled as it flows through the regenerator 500. That is, the regenerator 500 absorbs heat from the working fluid before the working fluid passes into the cold path 366. This heat is transferred back to the working fluid when the regenerator 500 is rotated back to the first position as described above.

In the third position, FIG. 21C, working fluid cannot flow through the valve 514 and flow through the engine 350 is temporarily stopped or slowed.

FIGS. 22A–23B illustrates a modified embodiment of a regenerator 550. In this embodiment, the regenerator 550 includes a generally cylindrical valve 552, with at least a first end 554 and an outer cylindrical surface 555. The valve 552 preferably defines a generally U-shaped internal path 556 with first and second openings 558, 560 located on the first end 554 of the valve 552. The illustrated valve 552 is configured to rotate about a longitudinal axis 562. Positioned within the path 556 is a heat absorber transfer/device 564 as described above.

Figure 23A:
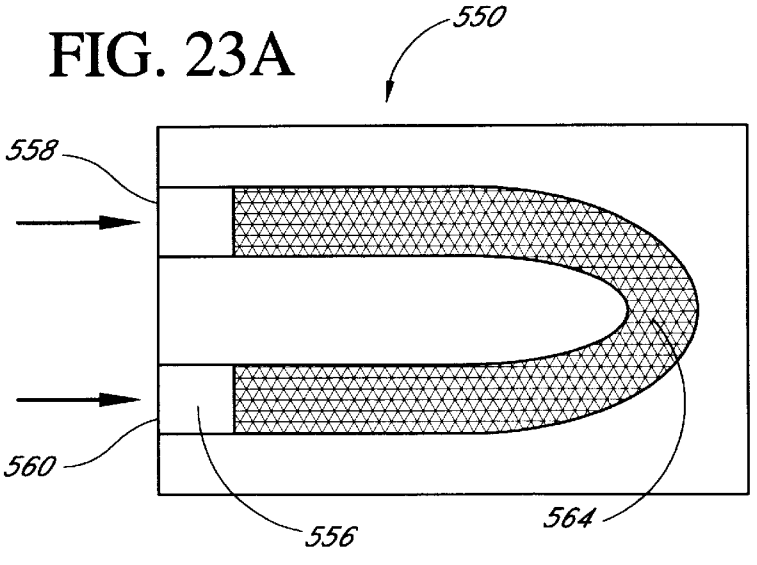
FIGS. 23A–B are cross-sections views of the regenerator of FIGS. 22A–B.
Figure 23B:
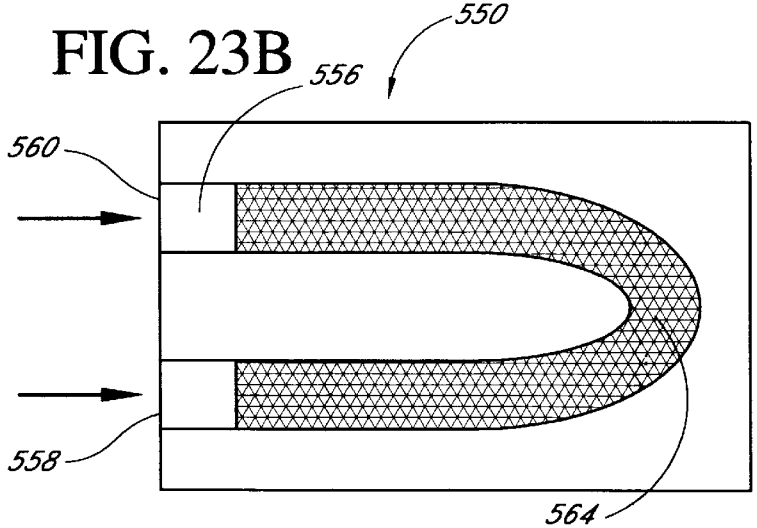
Figure 22A:
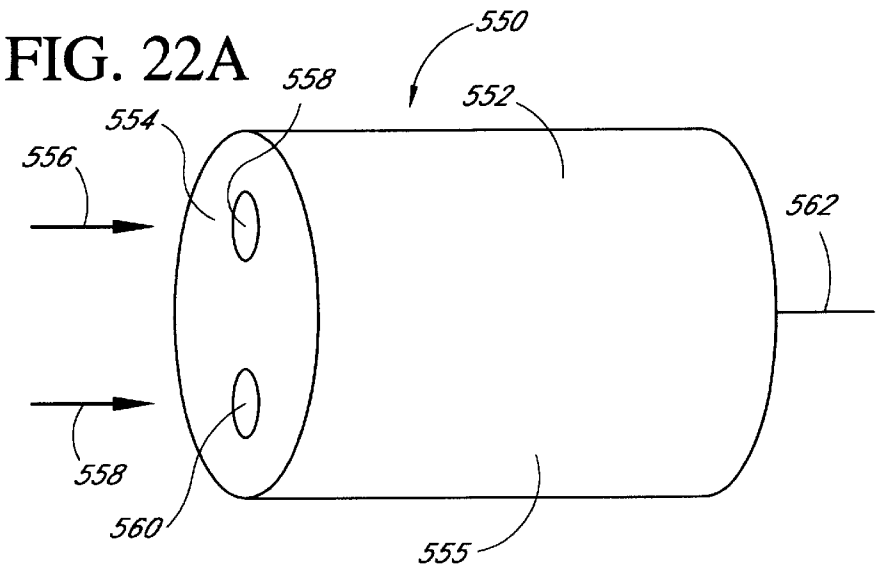
FIGS. 22A–B are perspective views of a modified embodiment of a regenerator.
Figure 22B:
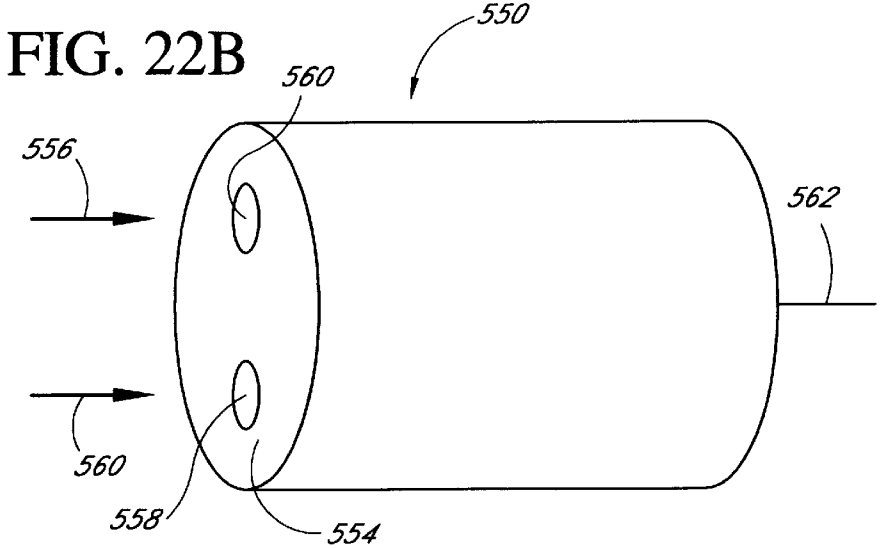

In a first position, illustrated in FIGS. 22A and 23B, the first opening 558 is aligned with an outlet 566 of the working fluid space 368 and the second opening 260 is aligned with the inlet 568 of the hot path 364. In this manner, the working fluid is heated as it is transferred to the hot path 364 as described above with respect to FIG. 21A. In a second position, the second opening 560 is aligned with the outlet of the working fluid space 368 and the first opening 558 is aligned with an inlet 570 to the cold path 366. In this manner, heat is removed from the working fluid as it is transferred to the cold path 366 as described above with respect to FIG. 21A. In a modified embodiment, the hot path 364, cold path 366 and/or the working space 368 or portions thereof can be rotated with respect to the regenerator 550.

Figure 24:
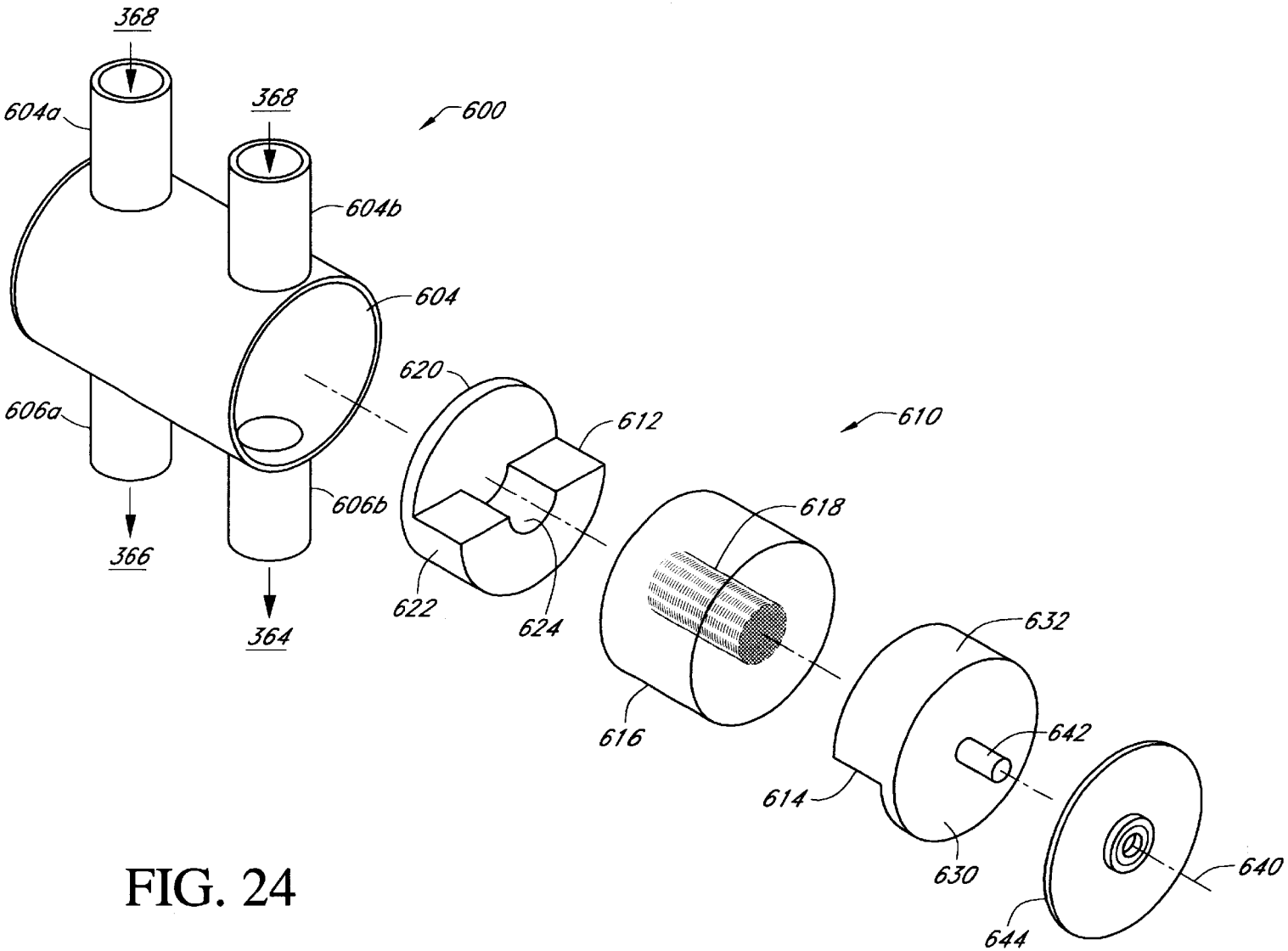
FIG. 24 is an exploded view of another modified embodiment of a regenerator.
Figure 25A:
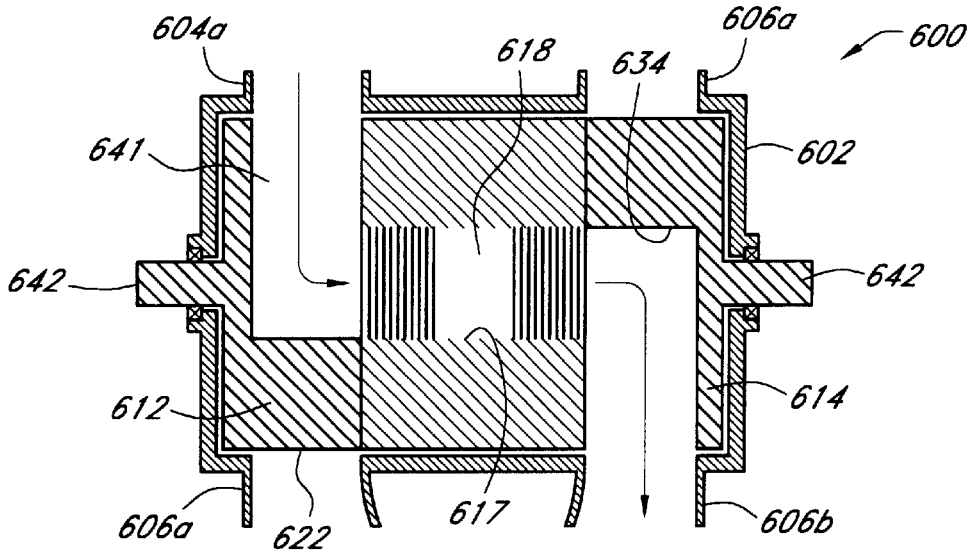
FIG. 25A is a cross-sectional view of the regenerator of FIG. 24 in a first position.
Figure 25B:
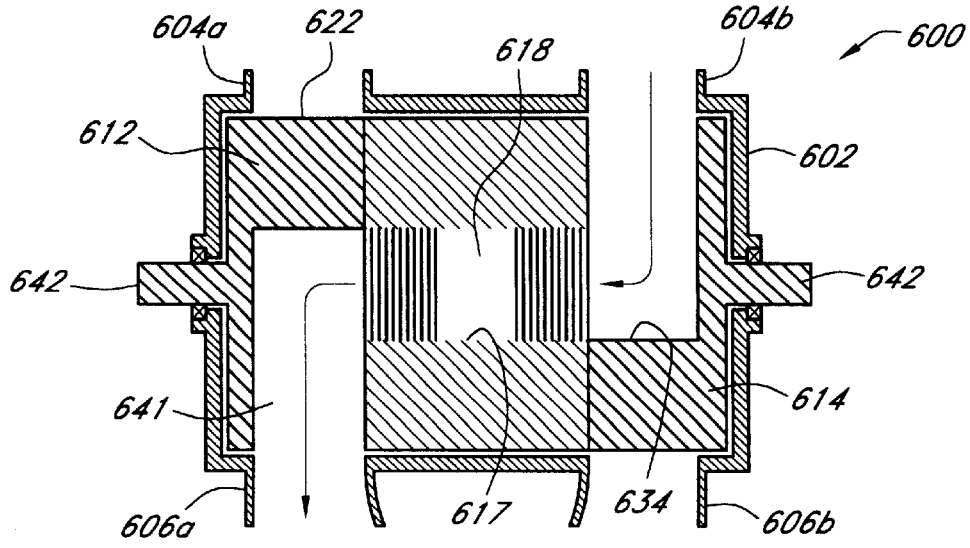
FIG. 25B is a cross-sectional view of the regenerator of FIG. 24 in a second position.

FIGS. 24–25B illustrate yet another embodiment of a regenerator 600. This embodiment includes a valve housing 602, which defines a generally cylindrical valve chamber 604. The illustrated housing 602 includes two inlet ports 604*a*, 604*b*, which define inlets paths that are in communication with the valve chamber 604 and the working space 368 of the Stirling engine. The housing 602 also includes two outlet ports 606*a*, 606*b*, which also define outlet paths that are also in communication with the valve chamber 602. The first outlet port 606*a* is in communication with the cold path 366 of the engine and the second outlet port 606*b* is in communication with the hot path 364 of the engine.

Positioned with the valve chamber 602 is a rotary assembly 610. The rotary assembly includes a cold side rotor 612, a hot side rotor 614 and a regenerator housing 616, which defines a regenerator path 617 in which a heat absorber/transfer device 618 is positioned. The cold side rotor includes an end portion 620, a side portion 622, and a channel 624. As will be explained in more detail below, the cold side rotor 612 is configured to rotate within the housing 602. As best seen in FIG. 25A in a first position, the side portion 622 blocks the first outlet port 606*a* and the channel 624 is in communication with the regenerator path 617 and the first inlet 604*a*. In a second position (FIG. 25B), the side portion 622 blocks the first inlet 604*a* and the channel 624 is in communication with the regenerator path 617 and the cold side first outlet port 606*a*.

Similarly, the hot side rotor 614 also includes an end portion 630, a side 632 portion, and a channel 634 (see FIG. 25A). As best seen in FIG. 25A, in a first position, the side portion 632 blocks inlet port 606*a* and the channel 634 are in communication with the regenerator 618 and the hot side outlet port 606*b*. In a second position (FIG. 25B), the side portion 632 blocks hot side outlet port 606*b* and the channel 634 are in communication with the regenerator 618 and the cold side outlet 606*a*.

The regenerator housing 616 is positioned between the hot and cold rotors 612, 614, and the regenerator path 617 connects the channels 624, 634 of the hot and cold rotors 612, 614. Preferably, the rotors 612, 614 and the regenerator housing 616 are coupled together and rotate about a common axis 640. In the illustrated embodiment, the end portions 620, 630 include shafts 642, which are journalled for rotation on end assemblies 644, which close the valve chamber 604. As such, the hot rotor, the cold rotor, and the regenerator housing 616 define a passage 641 through the rotor assembly 610. An electric motor or gear arrangement can be coupled to the shafts 642 to rotate the assembly 610. In a modified embodiment, the regenerator housing 616 can be stationary with respect to the valve housing 602 while the hot and cold rotors 612, 614 rotate within the housing 602 either independently or in conjunction with each other.

With reference to FIG. 25A, when the rotary valve 610 is in a first position, working fluid can flow from the first port 604*a* into the regenerator 618, through the hot side outlet 606*b* and into the hot path 364. In this manner, the working fluid is heated as it is transferred to the hot path 364 as described above with respect to FIG. 21A. In a second position (FIG. 25B), the working fluid can flow through the second inlet port 604*a* and into the regenerator 618, through the cold side outlet 606*a* and into the cold path 366. aligned with the working fluid space and the first opening is aligned with the cold path. In this manner, heat is removed from the working fluid as it is transferred to the cold path 366 as described above with respect to FIG. 21A.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or sub-combinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A Stirling cycle engine comprising:

a substantially sealed engine block that defines a working fluid space, a hot path and a cold path;

a heat source and a heat sink that are configured to keep the hot path and the cold path at different temperatures;

a valve chamber that is in communication with the working fluid space, the hot path and the cold path;

a valve moveably positioned within the valve chamber between at least a first position and a second position, the valve defining a passage that, in the first position, places the working fluid space in communication with the hot path and, in the second position, places the working fluid space in communication with the cold path; and a regenerator positioned within the passage.

2. A Stirling engine as in claim 1, wherein the valve is configured to continuously rotate about an axis in at least one direction between the first and second positions.

3. A Stirling engine as in claim 1, further comprising a working fluid circulator for circulating the working fluid within the engine block.

4. A Stirling engine as in claim 3, wherein the working fluid circulator is a fan.

5. A Stirling engine as in claim 4, wherein the valve is configured to rotate about an axis.

6. A Stirling engine as in claim 1, wherein the valve is configured to rotate about an axis.

7. A Stirling engine as in claim 6, wherein the valve chamber is cylindrical and the valve has a generally cylindrical outer surface that is generally centered about the axis.

8. A Stirling engine as in claim 7, wherein the valve includes at least one end surface and the passage includes a first opening and a second opening that are both positioned on the one end surface.

9. A Stirling engine as in claim 8, wherein the end surface is generally perpendicular to the axis.

10. A Stirling engine as in claim 8, wherein the passage is U-shaped.

11. A Stirling engine as in claim 7, wherein the passage includes a first opening and a second opening that are both positioned on the generally cylindrical outer surface.

12. A Stirling engine as in claim 11, wherein the first and second openings are connected by an intermediate passage that at least partially extends generally parallel with the axis.

13. A Stirling engine as in claim 12, wherein the regenerator is at least partially positioned within the intermediate passage.

14. A method of operating a Stirling cycle engine having a substantially sealed engine block that defines a working fluid space, a hot path and a cold path, the method comprising:

passing a working fluid through the hot path;

passing the working fluid into the working space;

passing the fluid through a regenerator and into the cold path;

passing the fluid through the cold path;

moving the regenerator such that it is in communication with the hot path and the working space;

passing the fluid into the working space; and passing the fluid through the regenerator into the hot path.

15. A method as in claim 14, further comprising operating a working fluid circulator.

16. A method as in claim 14, wherein moving the regenerator further comprises rotating the regenerator about an axis.

17. A method as in claim 16, wherein the regenerator is continuously rotated about the axis.

18. A method as in claim 16, wherein the regenerator oscillates about the axis.

19. A Stirling cycle engine comprising:

a substantially sealed engine block that defines a working fluid space, a hot path and a cold path;

a heat source and a heat sink that are configured to keep the hot path and the cold path at different temperatures;

a valve chamber that is in communication with the working fluid space, the hot path and the cold path;

a regenerator; and means for moving the regenerator so as to alternately direct working fluid from the working fluid space to the hot path and the cold path.

20. A Stirling engine as in claim 19, further comprising a working fluid circulator for circulating the working fluid within the engine block.

21. A Stirling cycle engine comprising:

a substantially sealed engine block that defines a generally cylindrical chamber, the engine block including a plurality of fins that extend into the chamber and divide the chamber into sub-chambers;

a rotary displacer that is suitably journalled for rotation within the engine block, the rotary displacer including a plurality of blades, each of the plurality of blades being positioned within an individual sub-chamber;

a drive motor with an output shaft coupled to the rotary displacer;

a controller operatively connected to the drive motor and configured to control the drive motor;

a piston that is in communication with the working fluid in the chamber; and a heat source positioned to heat one side of the engine block and a heat sink positioned to cool another side engine block.

22. A Stirling cycle engine comprising:

a substantially sealed engine block that defines a working fluid space, a hot path and a cold path; the hot path connected to the working fluid space at a hot inlet and a hot outlet and including a hot inlet valve and a hot outlet valve; the cold path connected to the working fluid space at a cold inlet and a cold outlet and including a cold inlet valve and a cold outlet valve;

a working fluid circulator for circulating the working fluid within the engine block;

a heat source and a heat sink that are configured to keep the hot path and the cold path at different temperatures; and a control system configured to alternately open and close the hot path and the cold path such that the working fluid is alternately passed through a first path that is defined, at least in part, by the hot path and the working fluid space and a second path that is defined, at least in part, by the cold path and the working fluid space.

* * * * *